US012031262B2

(12) United States Patent
Jung et al.

(10) Patent No.: US 12,031,262 B2
(45) Date of Patent: Jul. 9, 2024

(54) LAUNDRY TREATING APPARATUS

(71) Applicant: LG Electronics Inc., Seoul (KR)

(72) Inventors: Sungwoon Jung, Seoul (KR); Hyehyun Sim, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 81 days.

(21) Appl. No.: 17/496,461

(22) Filed: Oct. 7, 2021

(65) Prior Publication Data

US 2022/0112647 A1 Apr. 14, 2022

(30) Foreign Application Priority Data

Oct. 8, 2020 (KR) ..... 10-2020-0130148

(51) Int. Cl.
*D06F 39/08* (2006.01)
*D06F 23/02* (2006.01)
*D06F 39/02* (2006.01)

(52) U.S. Cl.
CPC ..... *D06F 39/028* (2013.01); *D06F 23/025* (2013.01); *D06F 39/088* (2013.01)

(58) Field of Classification Search
None
See application file for complete search history.

(56) References Cited

U.S. PATENT DOCUMENTS

| | | | | |
|---|---|---|---|---|
| 2012/0017649 | A1* | 1/2012 | Kim | D06F 37/26 68/139 |
| 2015/0114047 | A1 | 4/2015 | Jung et al. | |
| 2020/0232146 | A1* | 7/2020 | Jung | D06F 39/088 |

FOREIGN PATENT DOCUMENTS

| | | | | |
|---|---|---|---|---|
| CN | 202744828 | | 2/2013 | |
| CN | 109923259 | | 6/2019 | |
| CN | 110318211 | | 10/2019 | |
| DE | 10116832 | | 11/2002 | |
| EP | 3192916 | | 7/2017 | |
| EP | 3192916 | A1 * | 7/2017 | D06F 39/022 |
| WO | WO 2002081806 | | 10/2002 | |
| WO | WO2015049190 | | 4/2015 | |

OTHER PUBLICATIONS

CN202744828 English translation, Liquid type detergent automatic pouring device (Year: 2013).*
Extended European Search Report in European Appln. No. 21200886.6, dated Mar. 1, 2022, 9 pages.
Office Action in Chinese Appln. No. 202111171209.0, dated Mar. 16, 2023, 12 pages (with English translation).

* cited by examiner

*Primary Examiner* — Cristi J Tate-Sims
(74) *Attorney, Agent, or Firm* — Fish & Richardson P.C.

(57) ABSTRACT

A laundry treating apparatus includes a cabinet, a tub, a drum, and a detergent feeder. The detergent feeder includes a storage unit including therein a storage space for storing detergent therein, a detergent hose for flowing detergent delivered from the storage unit therethrough, and a water supply unit connected to the detergent hose to supply delivered detergent to the storage unit together with water. At least a portion of the detergent hose extends along an outer surface of the water supply unit, and a hose accommodating groove extending along a longitudinal direction of the detergent hose to accommodate the detergent hose therein is defined in the outer surface of the water supply unit.

20 Claims, 16 Drawing Sheets

LAUNDRY TREATING APPARATUS

CROSS-REFERENCE TO RELATED APPLICATION

This application claims the benefit of Korean Patent Application No. 10-2020-0130148, filed on Oct. 8, 2020, which is hereby incorporated by reference as if fully set forth herein.

TECHNICAL FIELD

The present disclosure relates to a laundry treating apparatus, and to a laundry treating apparatus having a detergent feeder.

BACKGROUND

A laundry treating apparatus is an apparatus that puts clothes, bedding, and the like (hereinafter, referred to as laundry) into a drum to remove contamination from the laundry. The laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a cabinet forming an appearance of the laundry treating apparatus, a tub accommodated in the cabinet, a drum that is rotatably mounted inside the tub and into which the laundry is put, and a detergent feeder that feeds detergent into the drum.

When the drum is rotated by a motor while wash water is supplied to the laundry accommodated in the drum, dirt on the laundry may be removed by friction with the drum and the wash water.

The detergent feeder has a detergent supply function to enhance a washing effect. In this connection, the detergent refers to a substance that enhances the washing effect, such as fabric detergent, fabric softener, fabric bleach, and the like. Detergent in a powder form and detergent in a liquid form may be used.

Korean Patent Publication Application KR 10-2018-0090003 A1 discloses a detergent feeder included in a laundry treating apparatus. The laundry treating apparatus may be used as a storage of the detergent feeder is inserted or withdrawn by a user.

The storage may include a storage space where the detergent is stored therein. After storing the detergent in the storage, the user may use the laundry treating apparatus by inserting the storage into the cabinet of the laundry treating apparatus.

Inside the laundry treating apparatus, various components in addition to the detergent feeder may be disposed. Therefore, it is an important task in the art to develop a detergent feeder that may minimize an increase in volume by not complicating a structure while securing sufficient capacity of a storage space within a limited space and may efficiently supply detergent.

SUMMARY

Embodiments of the present disclosure are intended to provide a laundry treating apparatus having a structure that may efficiently supply detergent with excellent space utilization through optimal arrangement between components.

In addition, embodiments of the present disclosure are intended to provide a laundry treating apparatus that may effectively secure a storage space of detergent while minimizing an increase in volume through a design considering spatiality.

In addition, embodiments of the present disclosure are intended to provide a laundry treating apparatus in which a sufficient amount of detergent of various types may be used, which is convenient to use and is able to effectively improve structural stability.

In addition, embodiments of the present disclosure are intended to provide a laundry treating apparatus that may effectively increase space utilization by minimizing an increase in volume by a detergent hose in a detergent feeder including the detergent hose.

One embodiment of the present disclosure includes a tub and a drum, and includes a detergent feeder that may supply detergent to the tub or the drum. The detergent feeder may include a storage in which detergent is stored and a water supply assembly that supplies water to the storage.

The water supply assembly may be connected to a detergent hose along which detergent is delivered from the storage. The water supply assembly may have a hose assembling portion to which the detergent hose is fastened.

The detergent hose may be extended along an outer surface of the water supply assembly and be connected to the water supply assembly. A hose accommodating groove into which the detergent hose may be inserted or accommodated may be defined in the water supply assembly.

As the hose accommodating groove is defined in the outer surface of the water supply assembly, in one embodiment of the present disclosure, even when the detergent hose is disposed on the outer surface of the water supply assembly, an increase in volume of the detergent feeder may be minimized. Accordingly, a storage space of the storage may be secured in the same space, so that a capacity of detergent stored in the storage may be effectively increased.

In addition, the hose assembling portion, that is, a hose connector may extend in parallel with the detergent hose to minimize an assembly space. Accordingly, it may be possible to minimize a level at which the detergent hose connected to the hose connector protrudes from the detergent feeder, and it may be advantageous to secure the storage space of the storage in the same space.

According to an aspect of the present disclosure, provided is a laundry treating apparatus including a cabinet, a tub, a drum, and a detergent feeder.

The tub is disposed inside the cabinet, and accommodates water therein. The drum is disposed rotatably inside the tub, and accommodates laundry therein. The detergent feeder is disposed inside the cabinet, and supplies detergent into the tub.

The detergent feeder includes a storage, a detergent hose, and a water supply assembly. The storage includes therein a storage space for storing detergent therein. The detergent hose flows detergent delivered from the storage therethrough. The water supply assembly is connected to the detergent hose to supply delivered detergent to the storage together with water.

At least a portion of the detergent hose extends along an outer surface of the water supply assembly, and a hose accommodating groove extending along a longitudinal direction of the detergent hose to accommodate the detergent hose therein is defined in the outer surface of the water supply assembly.

In one implementation, the storage space may include a first space for storing first detergent therein and in communication with the detergent hose, and a second space for storing second detergent therein, the water supply assembly may be configured to receive the first detergent through the detergent hose and supply the first detergent to the second space, and the storage may include a detergent discharge portion for discharging detergent of the second space to the outside.

In one implementation, the water supply assembly may include a water supply connector connected to a water supply hose for flowing water therethrough, a water supply flow channel extending from the water supply connector, wherein water flows through the water supply flow channel, a water supply connected to the water supply flow channel to discharge water to the second space, and a detergent connector in communication with the water supply.

The detergent hose may extend along the hose accommodating groove and may be connected to the detergent connector to deliver the first detergent to the water supply.

In one implementation, the water supply may face the second space, and the detergent connector may be located on a side opposite to the second space with respect to the water supply.

In one implementation, the water supply assembly may include a hose retainer located on open one surface of the hose accommodating groove to suppress departure of the detergent hose.

In one implementation, the water supply assembly may include a detergent connector in communication with the water supply, and the detergent connector may include an extending coupling portion extending in parallel with the longitudinal direction of the detergent hose accommodated in the hose accommodating groove, wherein the detergent hose is coupled to the extending coupling portion.

In one implementation, a backflow preventing portion for preventing backflow of detergent flowing along the detergent hose may be disposed inside the detergent connector or the detergent hose.

In one implementation, a connector accommodating portion recessed inwardly of the water supply assembly and connected to the hose accommodating groove may be defined in the outer surface of the water supply assembly, and the detergent connector may be disposed in the connector accommodating portion, and the extending coupling portion may be disposed parallel to the connector accommodating portion while facing the detergent hose.

In one implementation, the connector accommodating portion may have a greater width than the hose accommodating groove.

In one implementation, a mixing inhibiting rib may be disposed inside the water supply, wherein the mixing inhibiting rib is in communication with the detergent connector and is configured to surround a detergent space where detergent flows to inhibit mixing of detergent and water in the water supply.

In one implementation, the water supply assembly may include a water supply base configured such that one surface of each of the water supply and the water supply flow channel is opened, and a water supply cover coupled to the water supply base to close said one open surface of each of the water supply and the water supply flow channel.

The mixing inhibiting rib may include a first inhibiting rib protruding from the water supply base and a second inhibiting rib protruding from the water supply cover.

In one implementation, one of the first inhibiting rib and the second inhibiting rib may be disposed to surround the other.

In one implementation, the water supply may have a water discharge hole and a detergent discharge hole defined in one surface facing the storage thereof, wherein the water discharge hole discharges water therethrough, and the detergent discharge hole is in communication with the detergent space to discharge detergent therethrough.

In one implementation, detergent may flow through the detergent discharge hole as a shielding portion for blocking flow of detergent is disposed in a portion of the detergent discharge hole, and the remaining portion of the detergent discharge hole is opened.

In one implementation, the detergent feeder may further include a supply casing for accommodating the storage therein, and including a drain portion for discharging detergent discharged toward the tub through the detergent discharge portion.

In one implementation, the supply casing may include a detergent pump connected to the first space of the storage to flow the first detergent, and the detergent hose may be connected to the detergent pump to flow the first detergent.

According to another aspect of the present disclosure, provided is a laundry treating apparatus including a cabinet, a tub disposed inside the cabinet, and accommodating water therein, a drum disposed rotatably inside the tub, and accommodating laundry therein, and a detergent feeder disposed inside the cabinet, and supplying detergent into the tub.

The detergent feeder includes a storage including therein a storage space for storing detergent therein, a detergent hose for flowing detergent flowing out from the storage therethrough, and a water supply assembly connected to the detergent hose to supply delivered detergent to the storage together with water.

At least a portion of the detergent hose extends along an outer surface of the water supply assembly, a detergent connector coupled to the detergent hose is disposed on the outer surface of the water supply assembly, and the detergent connector includes an extending coupling portion extending along a longitudinal direction of the detergent hose, wherein the detergent hose is coupled to the extending coupling portion along the longitudinal direction.

Embodiments of the present disclosure may provide the laundry treating apparatus having the structure that may efficiently supply the detergent with the excellent space utilization through the optimal arrangement between the components.

In addition, embodiments of the present disclosure may provide the laundry treating apparatus that may effectively secure the storage space of the detergent while minimizing the increase in the volume through the design considering spatiality.

In addition, embodiments of the present disclosure may provide the laundry treating apparatus in which the sufficient amount of detergent of the various types may be used, which is convenient to use and is able to effectively improve the structural stability.

In addition, embodiments of the present disclosure may provide the laundry treating apparatus that may effectively increase the space utilization by minimizing the increase in the volume by the detergent hose in the detergent feeder including the detergent hose.

DETAILED DESCRIPTION

Figure 1:
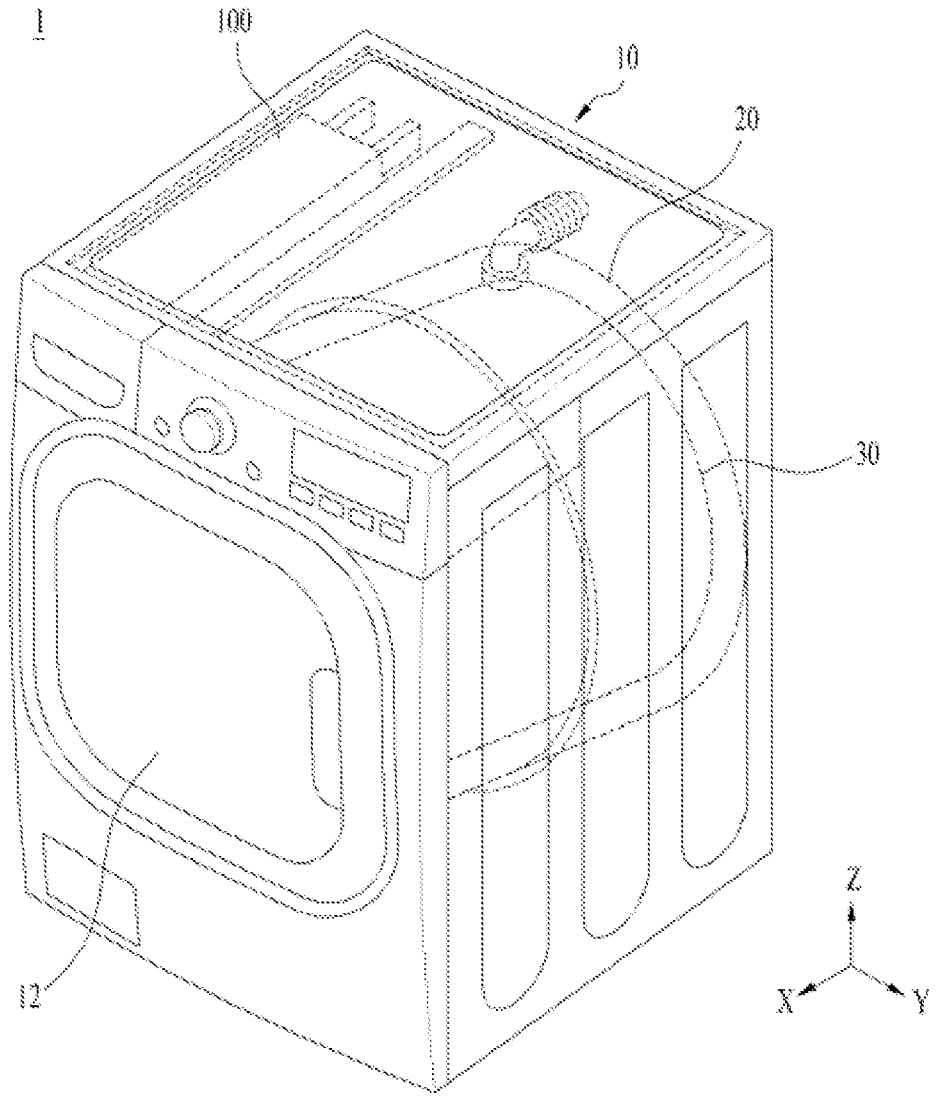
FIG. 1 is a view showing a laundry treating apparatus according to an embodiment of the present disclosure.

Hereinafter, an embodiment of the present disclosure will be described in detail with reference to the accompanying drawings such that a person having ordinary knowledge in the technical field to which the present disclosure belongs may easily implement the embodiment.

However, the present disclosure is able to be implemented in various different forms and is not limited to the embodiment described herein. In addition, in order to clearly describe the present disclosure, components irrelevant to the description are omitted in the drawings. Further, similar reference numerals are assigned to similar components throughout the specification.

Duplicate descriptions of the same components are omitted herein.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

The terminology used in the detailed description is for the purpose of describing the embodiments of the present disclosure only and is not intended to be limiting of the present disclosure.

As used herein, the singular forms 'a' and 'an' are intended to include the plural forms as well, unless the context clearly indicates otherwise.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in this specification, the term 'and/or' includes a combination of a plurality of listed items or any of the plurality of listed items. In the present specification, 'A or B' may include 'A', 'B', or 'both A and B'.

Figure 2:
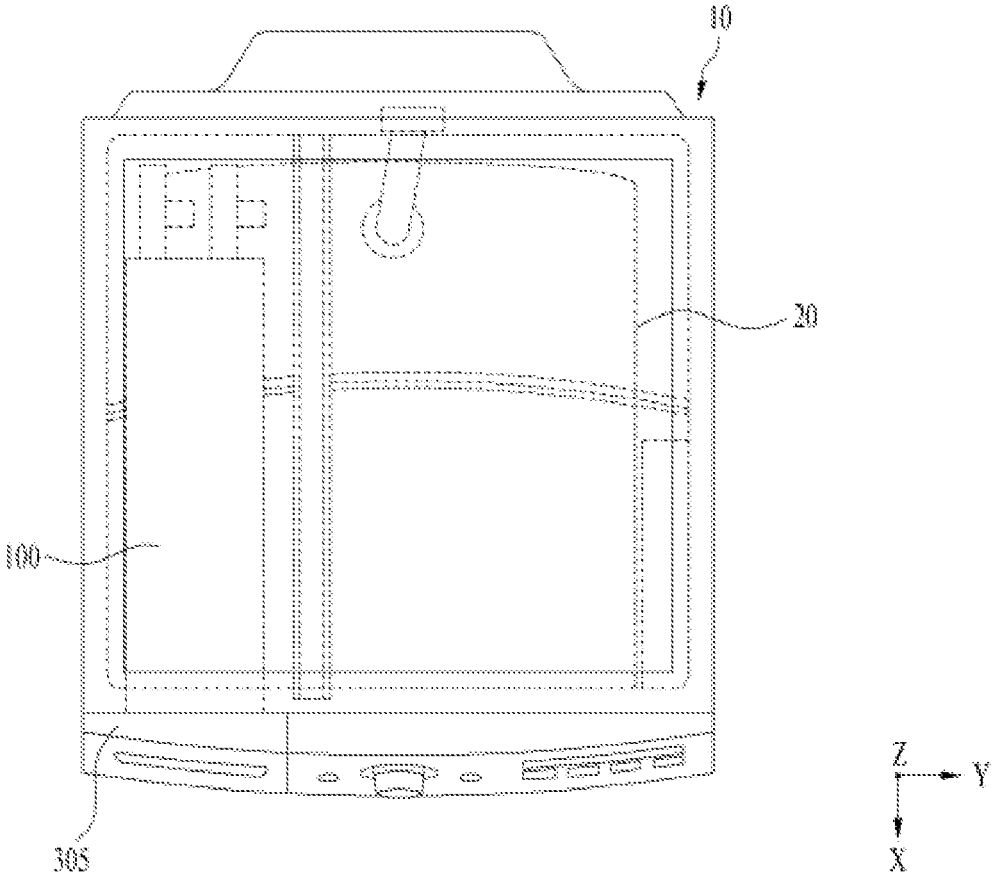
FIG. 2 is a view of a laundry treating apparatus according to an embodiment of the present disclosure viewed from above.
Figure 3:
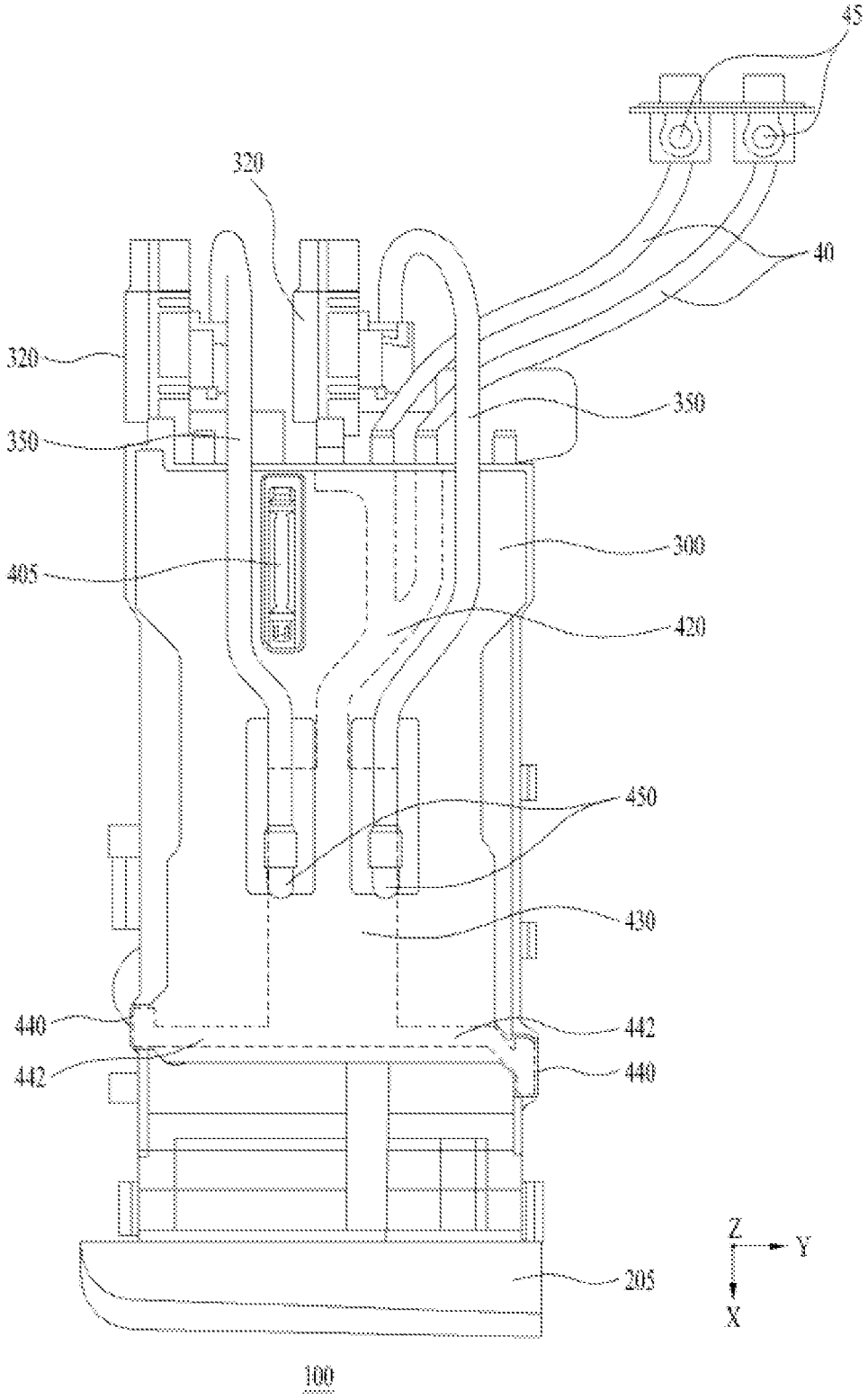
FIG. 3 is a view showing a detergent feeder in a laundry treating apparatus according to an embodiment of the present disclosure.

FIG. 1 is a perspective view showing a laundry treating apparatus 1 according to an embodiment of the present disclosure, and FIG. 2 is a view of the laundry treating apparatus 1 viewed from above. FIG. 3 is a top view showing a detergent feeder 100 of the laundry treating apparatus 1 according to an embodiment of the present disclosure.

Referring to FIGS. 1 to 3, the laundry treating apparatus 1 according to an embodiment of the present disclosure includes a cabinet 10 having a detergent opening 18 defined in a front surface thereof, a tub 20 installed inside the cabinet 10, a drum 30 rotatably installed inside the tub 20, and the detergent feeder 100.

The laundry treating apparatus 1 may include a washing machine in which a cloth is inserted into the drum 30 to be subjected to washing, rinsing, and dehydration, a dryer in which a wet cloth is inserted to be subjected to drying, or the like.

The laundry treating apparatus 1 may be divided into a top load-type apparatus and a front load-type apparatus. FIG. 1 shows the laundry treating apparatus 1 of the front load-type, which is only for convenience of description, and is also applicable to the top load-type washing machines because the present disclosure does not apply only to the front load-type washing machines.

As shown in FIG. 1, the laundry treating apparatus 1 includes the cabinet 10 that forms an appearance thereof. The cabinet 10 may include a manipulation unit that receives various control commands from a user and displays information on an operating state. The manipulation unit may include a display for displaying the operating state.

The cabinet 10 may have a laundry opening and a laundry door 12 respectively defined in and formed on a front surface 15 thereof. The user may put laundry, such as clothing, into the drum 30 through the laundry opening of the cabinet 10. The laundry door 12 may be pivotably formed on the cabinet 10 using a hinge or the like, and may be configured to open and close the laundry opening.

The cabinet 10, which forms the appearance of the laundry treating apparatus 1, may have a space defined therein in which various components constituting the laundry treating apparatus 1 may be accommodated. The drum 30 for accommodating therein the laundry input through the laundry opening may be installed inside the cabinet 10.

Inside the cabinet 10, the tub 20 for containing wash water therein, and the drum 30 rotatably disposed in the tub 20 and accommodating the laundry therein may be disposed. A balancer for compensating for eccentricity occurred by rotation may be installed on one side of the drum 30.

The above-described manipulation unit may include various keys for operating the operating state of the laundry treating apparatus 1 and the display for displaying the operating state of the laundry treating apparatus 1. The laundry door 12 may contain a transparent member such as tempered glass such that an interior of the cabinet 10 or the drum 30 may be visually identified.

In one example, in one embodiment of the present disclosure, the laundry treating apparatus 1 may have the detergent opening 18 on the front surface 15 thereof, and a detergent feeder 100 may be positioned inside the cabinet 10 at the rear of the detergent opening 18.

A location and a shape of the detergent opening 18 may vary. FIG. 1 shows the detergent opening 18 defined in the front surface 15 of the cabinet 10 and including an open hole. The detergent opening 18 may be located in a corner region on the front surface 15 of the cabinet 10, for example, on one side of an upper end of the front surface 15, parallel to the manipulation unit in a lateral direction.

The front surface 15 of the cabinet 10 may be formed in a form of a panel. For example, the cabinet 10 may include a front panel, a rear panel, side panels, a top panel, and a bottom panel. The definition of the direction in the present disclosure may be centered around the cabinet 10.

For example, in the cabinet 10, one surface in which the detergent opening 18 is defined may correspond to a front surface of the present disclosure. In addition, a front and rear direction may correspond to an insertion and withdrawal direction of a storage unit 200, which will be described later.

The storage unit 200 may be moved rearwardly into the cabinet 10 to be inserted into the cabinet 10 through the detergent opening 18, and may be moved forward at the interior of the cabinet 10 to be withdrawn out of the cabinet 10 through the detergent opening 18.

In one example, the detergent feeder 100 located at the rear of the detergent opening 18 may be located inside the cabinet 10 on one side of an upper portion of the cabinet 10. FIG. 2 shows the detergent feeder 100 positioned on one sides of the upper portion of the cabinet 10 as an embodiment of the present disclosure, but the location of the detergent feeder 100 is not necessarily limited thereto.

The detergent feeder 100 may include the storage unit 200 that may store detergent therein, a supply casing 300 that accommodates the storage unit 200 inserted into the cabinet 10 therein, and a water supply unit 400 that supplies water to the storage unit 200. FIG. 3 is the top view of the detergent feeder 100.

The detergent feeder 100 may supply the detergent stored in the storage unit 200 into the drum 30 or the tub 20 in a washing process or the like. The detergent means a substance that may enhance a washing effect of the laundry or a care effect of the laundry.

For example, the detergent may include a powdered or liquid fiber detergent and a liquid fabric softener.

Referring to FIG. 3, the laundry treating apparatus 1 according to an embodiment of the present disclosure may have a water supply valve 45 inside the cabinet 10. The water supply valve 45 may be connected to an external water supply source located outside the laundry treating apparatus 1, and may be configured to regulate flow of water supplied from the external water supply source.

For example, the water supply valve 45 may be in an open state to allow the flow of the water supplied from the external water supply source, or may be in a closed state to block the flow of the water. The water introduced through the water supply valve 45 may flow through a water supply hose 40 and be supplied to the detergent feeder 100.

FIG. 3 shows a pair of water supply valves 45 according to an embodiment of the present disclosure. One of the pair of water supply valves 45 may be connected to an external water supply source for cold water, and the other may be connected to an external water supply source for hot water.

The water supply hose 40 may also include a pair of water supply hoses, and one of the pair of water supply hoses may be coupled to the water supply valve 45 that is connected to the external water supply source for the cold water, and the other may be coupled to the water supply valve 45 that is connected to the external water supply source for the hot water.

The detergent feeder 100 may include a water supply connector 410 to which the water supply hose 40 is coupled. The water supply connector 410 may be disposed on the water supply unit 400, and the water supply unit 400 may include a water supply flow channel 420 through which water supplied through the water supply connector 410 flows, and may include a water supply portion 430 for supplying water supplied through the water supply flow channel 420 to the storage unit 200.

The water supply unit 400 may include a shower flow channel 442 extending from the water supply portion 430, and may include a shower portion 440 that receives water through the shower flow channel 442 and supplies the water to the supply casing 300. Because the shower portion 440 is supplied with water from the water supply portion 430, and the water supply portion 430 is supplied with water from the water supply hose 40 in which the flow of the water is regulated by the water supply valve 45, whether to operate the water supply portion 430 and the shower portion 440 may be determined only by controlling the single water supply valve 45.

In addition, the water supply unit 400 may have a fastening elastic protrusion 405 that provides sensory information on the insertion and withdrawal of the storage unit 200 to the user and improves usability by providing an elastic force to the storage unit 200 while being elastically deformed and restored by the storage unit 200 in the process of insertion and withdrawal of the storage unit 200.

The storage unit 200 may include a handle 205, and at least some of the detergent inside the storage unit 200 may flow out through a detergent pump 320 and be supplied to the water supply unit 400 through a detergent hose 350. The water supply unit 400 may have a detergent connector 450 to which the detergent hose 350 is coupled. A detailed description of the detergent flow between the storage unit 200 and the water supply unit 400 will be described later.

Figure 4:
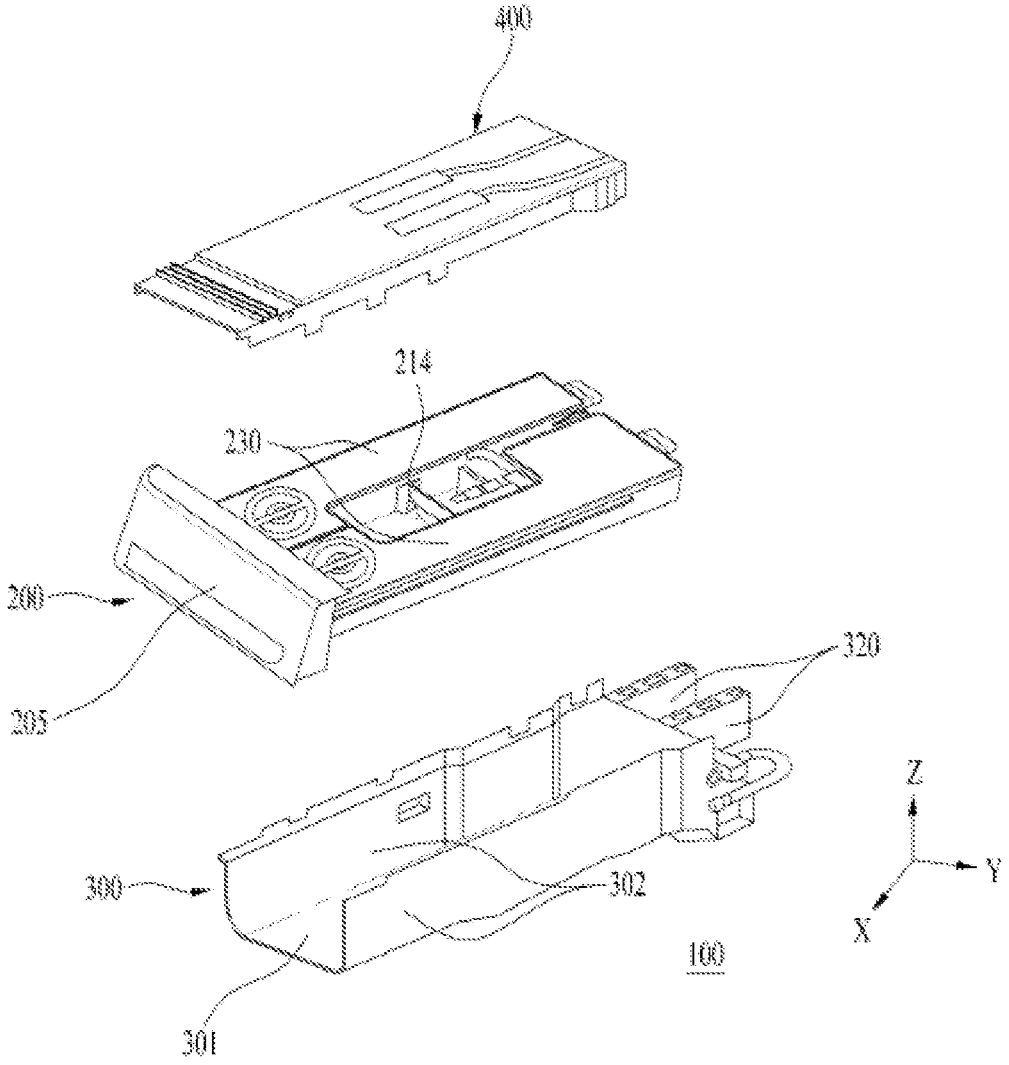
FIG. 4 shows a decomposed state of a detergent feeder in a laundry treating apparatus according to an embodiment of the present disclosure.

FIG. 4 shows a decomposed state of the detergent feeder 100. In the detergent feeder 100, the storage unit 200 may be located underneath the water supply unit 400, and the supply casing 300 may be located underneath the storage unit 200 based on FIG. 4.

The water supply unit 400 may receive water from the outside, and supply the received water back into the storage unit 200 or the supply casing 300. The water supply unit 400 may receive water from the external water supply source through the water supply hose 40 and the water supply valve 45.

The storage unit 200 may include a storage space 210 defined therein in which the detergent and the like are stored. The storage space 210 may be divided into a plurality of spaces. For example, the storage space 210 may include a first space 212 in which first detergent is stored and a second space 214 in which second detergent is stored.

The storage unit 200 may include a storage frame in which the storage space 210 is defined, the handle 205 disposed on a front surface of the storage frame, and a detergent cover 230 that is coupled to the storage frame and closes at least a portion of the storage space 210.

The supply casing 300 may include a bottom surface 301 positioned underneath the storage unit 200, and side walls 302 respectively positioned on both sides of the bottom surface 301 and the storage unit 200 in the lateral direction. The side walls 302 may be connected to the both sides of the bottom surface 301 in the lateral direction.

A space in which the storage unit 200 is accommodated may be defined in the supply casing 300. That is, the supply casing 300 may be configured to accommodate the storage unit 200 inserted into the cabinet 10. As will be described later, the supply casing 300 may have a drain portion 310 on the bottom surface 301. The detergent and the water discharged from the storage unit 200 or the water supply unit 400 may be discharged to the outside of the supply casing 300 through the drain portion 310, and the water and the detergent discharged to the outside of the supply casing 300 may be provided into the tub 20 or the drum 30.

In one embodiment of the present disclosure, the storage unit 200 may be inserted into or withdrawn out of the cabinet 10 through the detergent opening 18 defined in the front surface 15 of the cabinet 10. That is, the storage unit 200 may be inserted or withdrawn along the front and rear direction.

In the present disclosure, even when the laundry door 12 and the detergent opening 18 are formed on different surfaces in the cabinet 10, front and rear sides may be defined based on the detergent opening 18 and the insertion and withdrawal direction of the storage unit 200.

Figure 5:
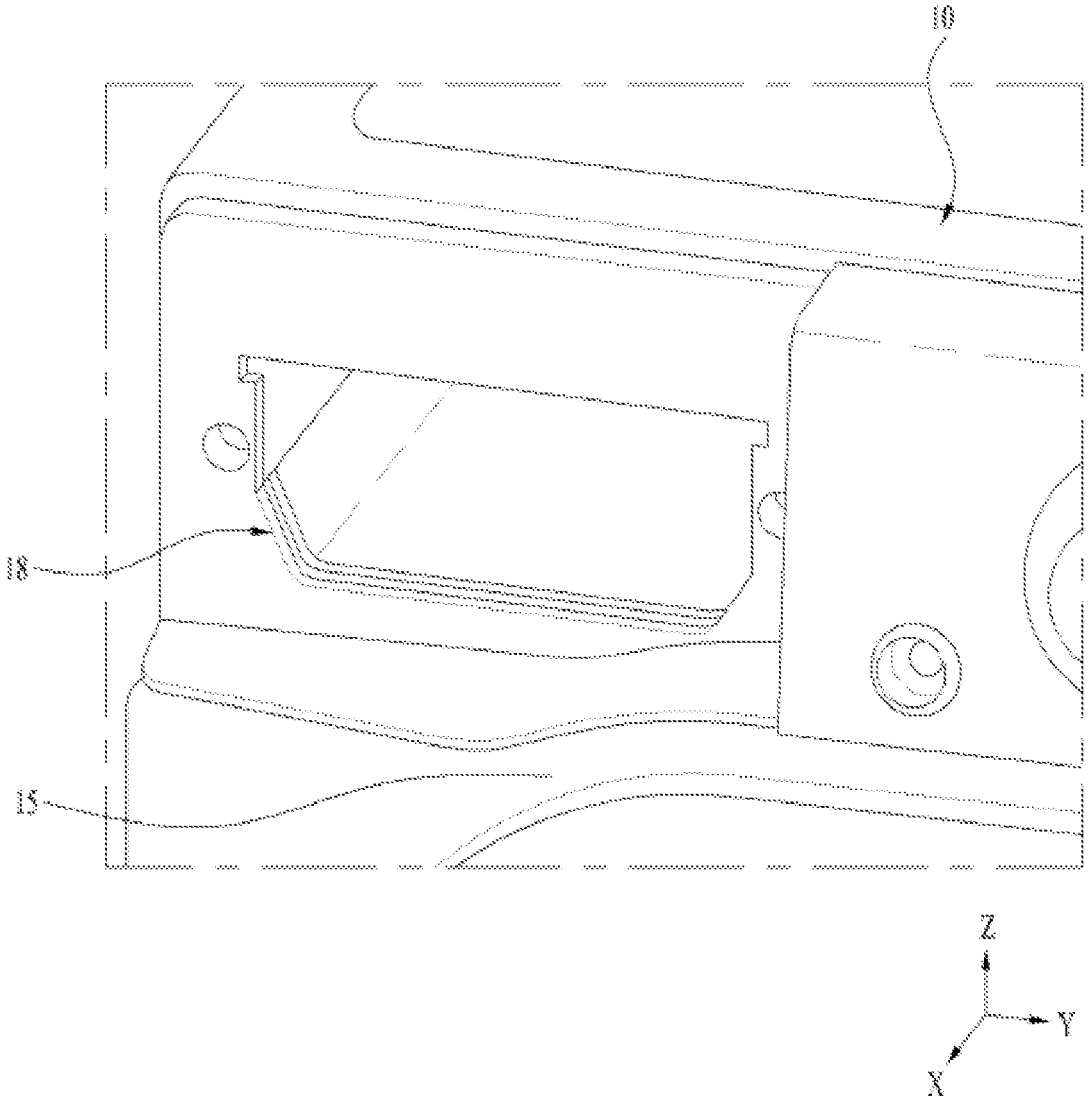
FIG. 5 shows a detergent opening defined in a cabinet of a laundry treating apparatus according to an embodiment of the present disclosure.

FIG. 5 shows the detergent opening 18 of the cabinet 10 viewed from the outside. A shape of the detergent opening 18 may vary. For example, an opening shape of the detergent opening 18 may correspond to a cross-sectional shape of the storage unit 200.

The detergent opening 18 may be defined in a portion of the front panel of the cabinet 10. The detergent opening 18 may be located on one side of an upper end of the front surface 15 of the cabinet 10. The detergent opening 18 may be located above the laundry door 12.

The detergent opening 18 may be depressed rearwardly than the remaining portion of the front surface 15 of the cabinet 10 excluding the detergent opening 18. As the detergent opening 18 is defined to be depressed, the handle 205 of the storage unit 200 may be positioned in front of the detergent opening 18 to form a portion of the front surface 15 of the cabinet 10.

Figure 6:
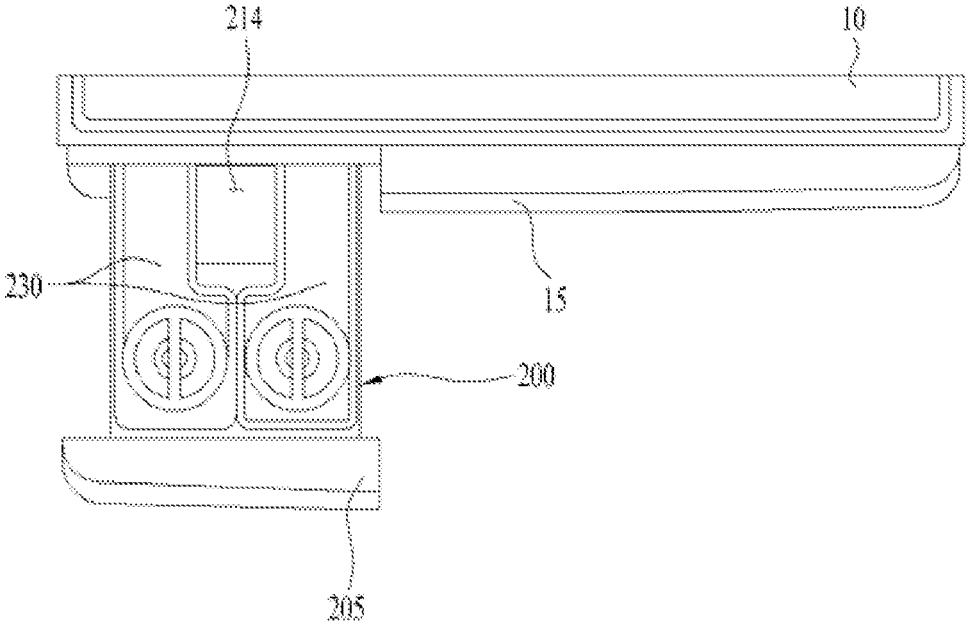
FIG. 6 is a view showing a storage extended through a detergent opening in a laundry treating apparatus according to an embodiment of the present disclosure.

In one example, FIG. 6 shows the storage unit 200 extended from the cabinet 10 through the detergent opening 18 in one embodiment of the present disclosure. It may be a state in which the handle 205 is exposed to the outside while the storage unit 200 is inserted into the cabinet 10.

When the storage unit 200 is withdrawn out of the cabinet 10, the user may pull the storage unit 200 out of the cabinet 10 by gripping the handle 205 and pulling the storage unit 200 out. The storage unit 200 may be extended by a set distance determined by design by a withdrawal limiting portion disposed in the storage unit 200.

In the state in which the storage unit 200 is withdrawn by the set distance, at least a portion of the first space 212 and the second space 214 may be exposed to the outside. In one embodiment of the present disclosure, the storage unit 200 may include the detergent cover 230 that closes the first space 212, and may further include a detergent cap that is detachably coupled to the detergent cover 230.

In the state in which the storage unit 200 is withdrawn by the set distance, the detergent cap may be exposed to the outside, and the user may separate the detergent cap from the storage unit 200 and put the detergent into the first space 212.

In the state in which the storage unit 200 is withdrawn by the set distance, at least a portion of the second space 214 may be exposed to the outside. The storage unit 200 may be configured such that one surface of the second space 214 is opened. For example, a top surface of the storage unit 200 may be opened as shown in FIG. 4. The user may put the detergent into the second space 214 through one open surface of the second space 214 exposed to the outside.

One embodiment of the present disclosure is advantageous in usability because the user may use the storage space 210 without completely separating the storage unit 200 from the cabinet 10 as the storage unit 200 is configured to be withdrawn by the set distance.

The withdrawal limiting portion may be configured such that at least a portion thereof is exposed in the state in which the storage unit 200 is withdrawn by the set distance, and the user may release the withdrawal distance limitation by the withdrawal limiting portion by manipulating the withdrawal limiting portion exposed to the outside. That is, the user may also manipulate the withdrawal limiting portion as needed to extend the storage unit 200 such that the cabinet is completely separated from the cabinet 10.

Figure 7:
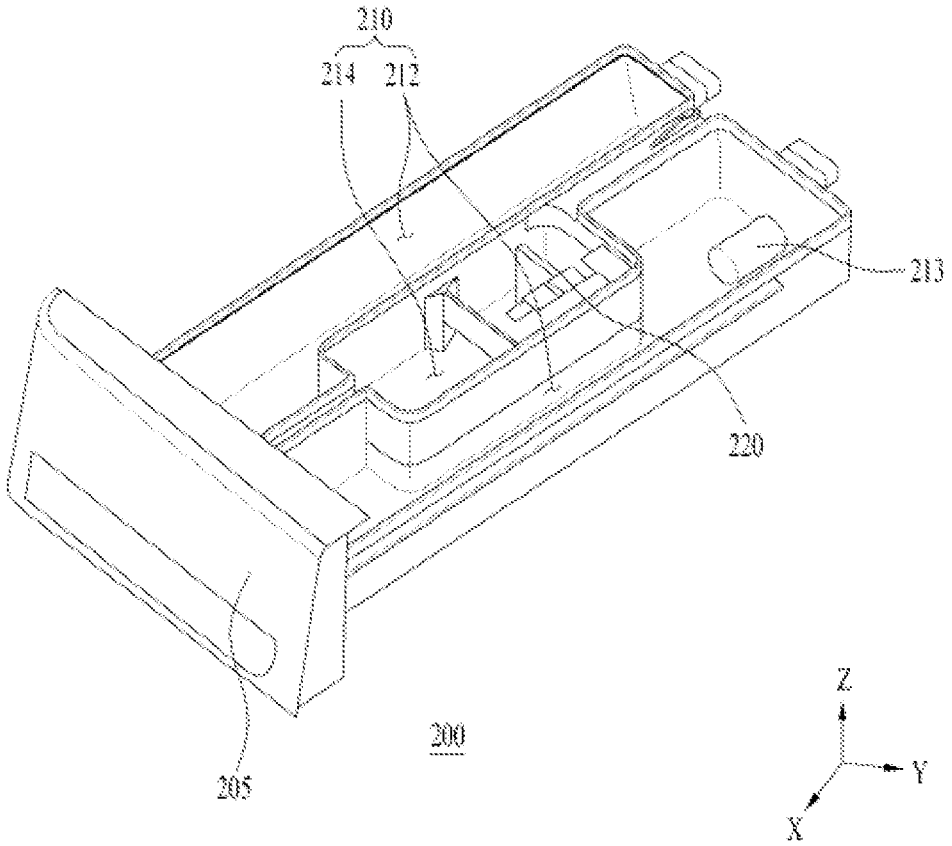
FIG. 7 is a view of a storage in a laundry treating apparatus according to an embodiment of the present disclosure.

In one example, FIG. 7 is a perspective view of the storage unit 200 from which the detergent cover 230 is separated. Referring to FIG. 7, in one embodiment of the present disclosure, the storage unit 200 may include the storage frame and the handle 205.

The handle 205 may be formed on the front surface of the storage frame. The handle 205 and the storage frame may be integrally molded or manufactured separately and coupled to each other. The handle 205 may form a portion of the front surface 15 of cabinet 10 in the state in which the storage unit 200 is inserted into the cabinet 10.

The storage frame may have the storage space 210 defined therein in which the detergent is stored. The storage space 210 may be defined such that one surface thereof is opened to allow the detergent to be injected. The storage frame may include a partition wall for partitioning the storage space 210 therein.

The storage space 210 may be divided into the plurality of spaces by the partition wall. The storage space 210 partitioned by the partition wall may include the first space 212 and the second space 214. The first detergent may be stored in the first space 212, and the second detergent may be stored in the second space 214.

The first detergent and the second detergent may only be distinguished based on to the stored spaces, and characteristics thereof may not necessarily be different. However, the present disclosure allows the user to use various detergents by having the plurality of regions where the detergent may be stored.

Referring to FIG. 7, the storage space 210 of the storage frame may include a plurality of first spaces 212 extending along a longitudinal direction of the storage frame, for example, the front and rear direction of the cabinet 10. In one example, the second space 214 partitioned by the partition wall portion may be defined between the first spaces 212.

The second space 214 may have a shape surrounded by the first spaces 212. The storage frame may include a detergent connecting portion 213 for discharging the first detergent in the first space 212 to the outside. The detergent connecting portion 213 may be formed in a shape of a pipe in which flow of the detergent may be regulated.

The detergent connecting portion 213 may be configured to penetrate a rear wall of the storage frame, and may be connected to a detergent pump 320 to be described later. For example, when the storage unit 200 is inserted into the cabinet 10, as the detergent pump 320 of the supply casing 300 and the detergent connecting portion 213 are connected to each other, and the detergent connecting portion 213 is configured to allow the detergent flow as the detergent pump 320 is connected thereto, the first detergent in the first space 212 may be leaked to the outside of the storage unit 200 by the detergent pump 320.

The storage unit 200 may include a detergent discharge portion 220 in communication with the second space 214. The detergent discharge portion 220 may be located in the second space 214 in the storage frame. The detergent discharge portion 220 may be configured as a passage through which the detergent and water present in the second space 214 are discharged to the outside.

The detergent discharge portion 220 may be disposed on a portion forming a bottom of the second space 214 in the storage frame. The detergent discharge portion 220 may include an opening for the detergent to be discharged, and the detergent or the like discharged through the detergent discharge portion 220 may be delivered to the bottom surface 301 of the supply casing 300.

Figure 8:
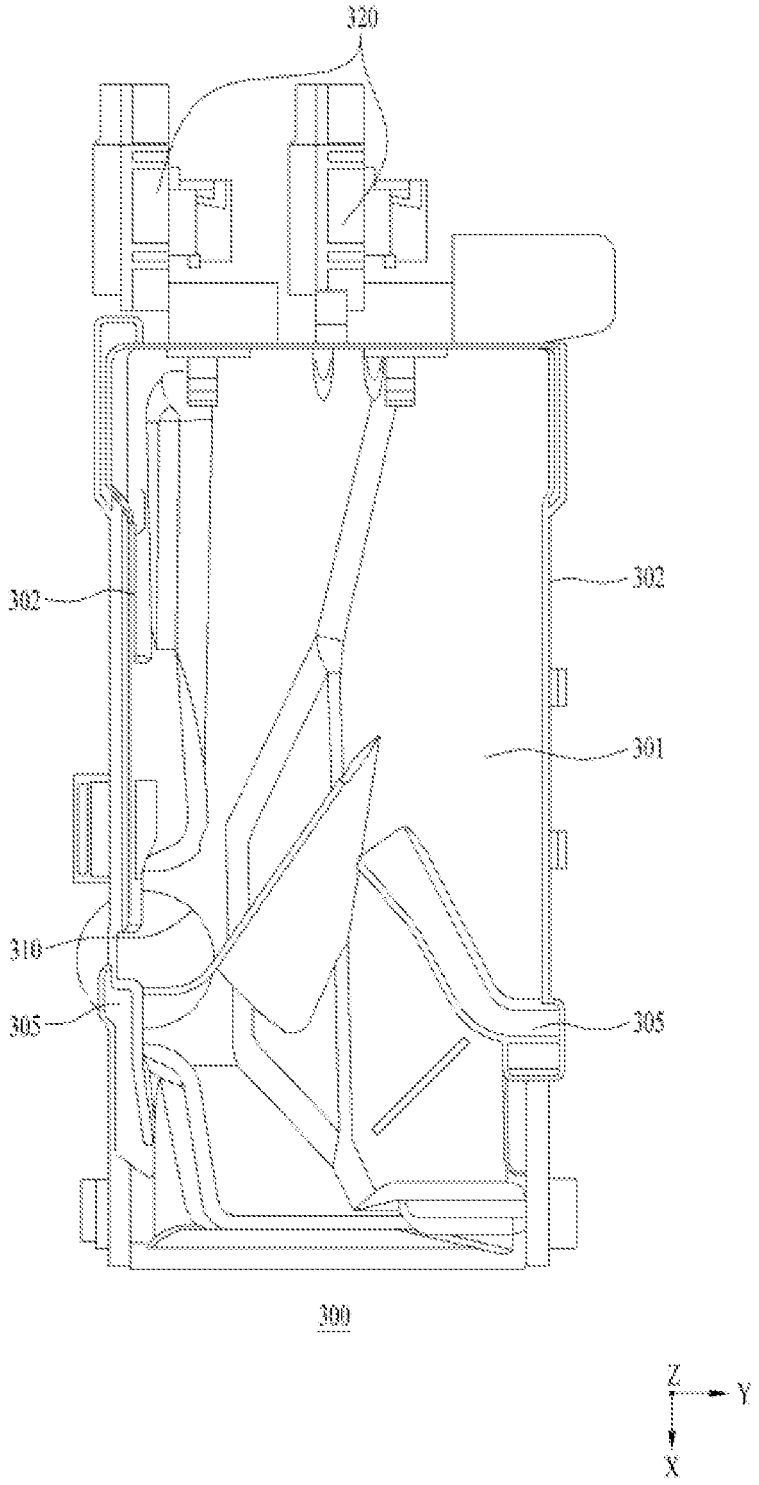
FIG. 8 shows a supply casing in a laundry treating apparatus according to an embodiment of the present disclosure.

FIG. 8 shows the supply casing 300 according to an embodiment of the present disclosure viewed from above. The supply casing 300 may include the bottom surface 301 and the side walls 302, and the storage unit 200 may be accommodated in a space defined by the bottom surface 301 and the side walls 302.

The supply casing 300 has the open front surface, so that storage unit 200, which is inserted into the cabinet 10 through the detergent opening 18, may move into the supply casing 300. The supply casing 300 has an open top surface, and a water supply unit 400 may be disposed on top of the supply casing 300.

As will be described later, the water supply unit 400 may be configured to discharge the water to the outside. The water discharged from the water supply unit 400 may be supplied into the storage unit 200 and the supply casing 300 through the open top surface of the supply casing 300.

The water supply unit 400 may be positioned above the supply casing 300 to shield the top surface of the supply casing 300. The water supply unit 400 may be coupled to the supply casing 300 to define a space in which the storage unit 200 is accommodated.

The storage unit 200 is inserted into the cabinet 10 through the detergent opening 18, and the supply casing 300 may have the detergent pump 320 connected to the storage unit 200 on the rear wall. The detergent pump 320 may be of various types.

FIG. 8 shows the detergent pump 320 including a plurality of detergent pumps to correspond to the number of first spaces 212 defined in the storage unit 200 according to an embodiment of the present disclosure. The detergent pump 320 is disposed on the rear wall of the supply casing 300, so that the detergent pump 320 may be connected to the storage unit 200 fully inserted into the cabinet 10.

The detergent pump 320 may be located at the rear of the rear wall of the supply casing 300 and may have a connector penetrating the rear wall of the supply casing 300. The connector may be connected to the detergent connecting portion 213 of the storage unit 200 that is introduced into the cabinet 10.

The bottom surface 301 of the supply casing 300 may be formed in a shape favorable to the flow of the detergent and the water. The supply casing 300 may have the drain portion 310 for discharging the detergent and the water on the bottom surface 301.

The drain portion 310 may be configured to discharge the detergent and the water to the outside through the opening. The detergent and the water discharged through the drain portion 310 may be supplied to the drum 30 or the tub 20. The bottom surface 301 of the supply casing 300 may be inclined or grooved such that the detergent and the water flow toward the drain portion 310.

A shower water flow groove 305 may be defined in the side wall 302 of the supply casing 300. The shower water flow groove 305 may extend from the side wall 302 of the supply casing 300 toward the bottom surface 301 of the supply casing 300, and may have a shape recessed in a direction away from the storage unit 200.

The shower water flow groove 305 may have an open top surface facing the water supply unit 400. The water discharged from the water supply unit 400 may be delivered into the shower water flow groove 305 and flow through the open top surface of the shower water flow groove 305.

As will be described later, the water supply unit 400 may include the shower portion 440 for supplying water to the supply casing 300 by avoiding the storage unit 200, and the shower water flow groove 305 may be positioned below the shower portion 440.

That is, water falling through the shower portion 440 of the water supply unit 400 may avoid the storage unit 200 and flow into the shower water flow groove 305. The shower water flow groove 305 may become means for guiding the water introduced through the shower portion 440 to flow through the entire bottom surface 301 including a front portion of the bottom surface 301 of the supply casing 300.

In one example, as described above, an embodiment of the present disclosure may include the cabinet 10, the tub 20, the drum 30, and the detergent feeder 100, and the tub 20 may be disposed inside the cabinet 10, and accommodate the water therein.

The drum 30 may be rotatably disposed inside the tub 20, and accommodate the laundry therein, and the detergent feeder 100 may be disposed inside the cabinet 10, and supply the detergent into the drum 30.

The detergent feeder 100 may include the storage unit 200, the detergent hose 350, and the water supply unit 400. The storage unit 200 may include therein the storage space 210 in which the detergent is stored, and the detergent flowing out from the storage unit 200 may flow through the detergent hose 350. The water supply unit 400 may be configured to supply the detergent delivered thereto as the water supply unit 400 is connected to the detergent hose 350 together with the water to the storage unit 200.

At least a portion of the detergent hose 350 may extend along the outer surface of the water supply unit 400, and a hose accommodating groove 460 extending along a longitudinal direction of the detergent hose 350 and accommodating the detergent hose 350 therein may be defined in the outer surface of the water supply unit 400.

Figure 9:
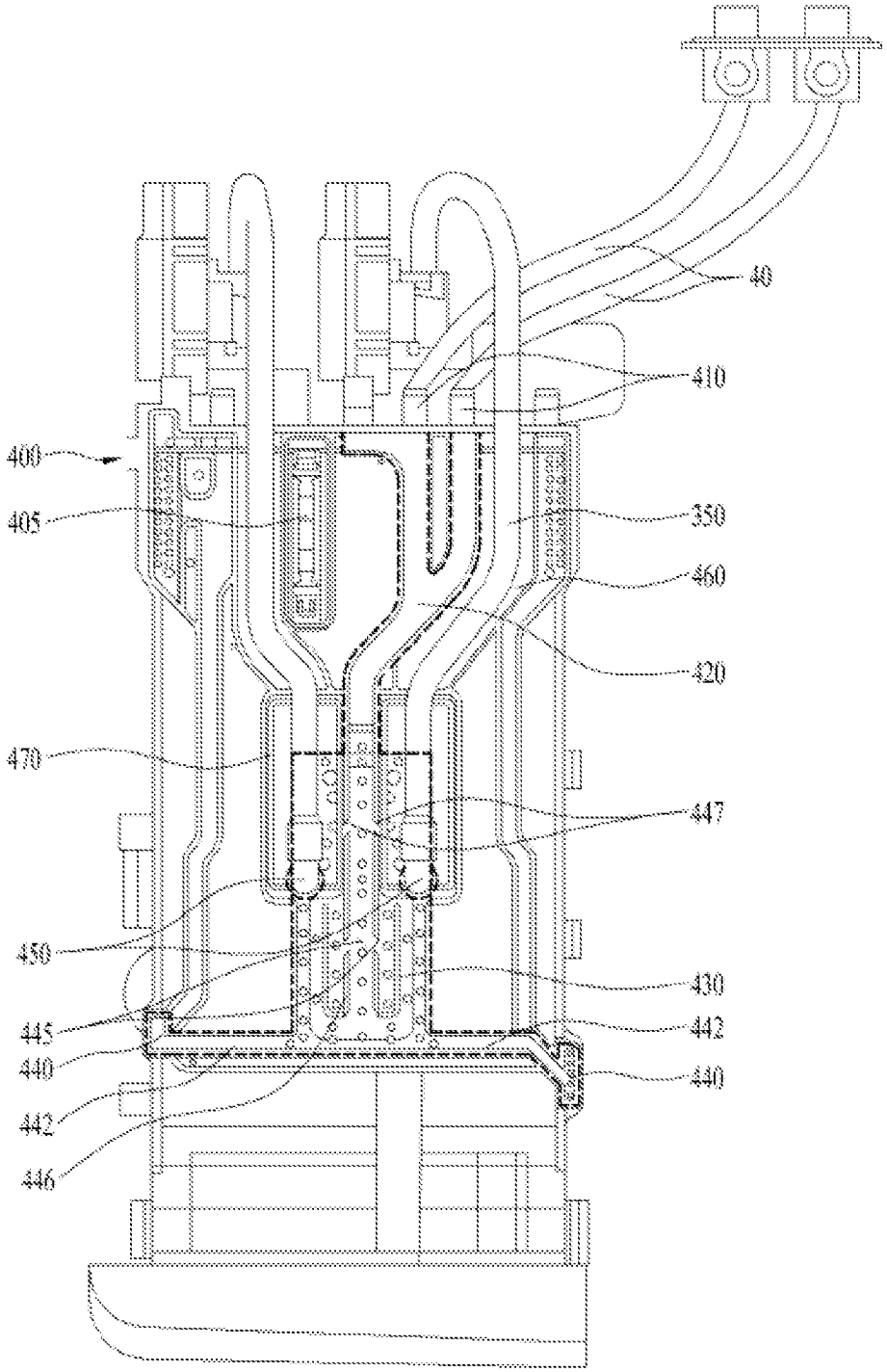
FIG. 9 shows a water supply assembly in a laundry treating apparatus according to an embodiment of the present disclosure viewed from above.

FIG. 9 shows the detergent feeder 100 having the detergent hose 350 and the hose accommodating groove 460 according to an embodiment of the present disclosure. Referring to FIG. 9, the detergent flowing out from the storage unit 200 may flow through the detergent hose 350. In addition, the water supply unit 400 may be connected to the detergent hose 350 to supply the detergent delivered from the storage unit 200 to the storage unit 200 together with the water.

One embodiment of the present disclosure may deliver at least some of the detergent of the storage unit 200 to the water supply unit 400, and the water supply unit 400 may supply the detergent delivered from the storage unit 200 back to the storage unit 200 together with the water.

Accordingly, the storage unit 200 may discharge the detergent provided with the water at once through the detergent discharge portion 220 or the like. Therefore, the detergent and the water may be supplied to the tub 20 in a structurally simple and efficient manner by omitting a separate component or structure for discharging the detergent and implementing a structure that may discharge the detergent together with the water.

Furthermore, because the separate structure for discharging the detergent is omitted, it is easy for the storage unit 200 to secure a space in the detergent feeder 100. Accordingly, as a capacity of the storage unit 200 is increased, it is possible to increase an amount of detergent stored in the storage space 210, which may be advantageous for treatment of mass laundry and may be advantageous for improving usability as a one-time filling amount increases.

In one example, at least a portion of the detergent hose 350 may extend along the outer surface of the water supply unit 400. FIG. 9 shows the detergent hose 350 extending along a top surface of the water supply unit 400 according to an embodiment of the present disclosure.

The detergent hose 350 may be directly connected to the storage unit 200 or connected to the detergent pump 320 described above, so that at least some of the detergent stored in the storage space 210 of the storage unit 200 may flow inside the detergent hose 350.

The detergent hose 350 may extend along the outer surface of the water supply unit 400 and be connected to the water supply unit 400. Accordingly, the water supply unit 400 may receive the detergent through the detergent hose 350 without defining a separate flow channel for the flow of the detergent therein, which may be advantageous for design and handling of the water supply unit 400.

For example, when the flow channel along which the detergent flows is separately formed inside the water supply unit 400, the detergent remaining in the flow channel along which the detergent flows is difficult to be washed, which may deteriorate hygiene and handling properties.

Therefore, in one embodiment of the present disclosure, as the detergent hose 350 is extended and directly coupled to the detergent connector 450 or the like on the outer surface of the water supply unit 400, the separate flow channel for the detergent flow may not be defined inside the water supply unit 400.

In one example, in one embodiment of the present disclosure, the hose accommodating groove 460 may be defined in the outer surface of the water supply unit 400. The hose accommodating groove 460 may extend along the longitudinal direction of the detergent hose 350 in the outer surface of the water supply unit 400, and may accommodate the detergent hose 350 therein.

FIG. 9 shows a state in which the detergent hose 350 extends along the top surface of the water supply unit 400, and the hose accommodating groove 460 extending in parallel with the detergent hose 350 is defined in the top surface of the water supply unit 400, according to one embodiment of the present disclosure.

The hose accommodating groove 460 may have a shape recessed in a direction away from the detergent hose 350. FIG. 9 shows a state in which the detergent hose 350 is located on the top surface of the water supply unit 400, and the hose accommodating groove has the shape of being recessed downward from the top surface of the water supply unit 400, according to an embodiment of the present disclosure.

In one embodiment of the present disclosure, the detergent pump 320 and the detergent hose 350 may be disposed at a rear portion of the detergent feeder 100 to minimize a lateral volume expansion of the detergent feeder 100. That is, the detergent hose 350 may extend forward from a rear end on the top surface of the water supply unit 400.

Accordingly, the hose accommodating groove 460 may extend forward from a rear end of the water supply unit 400. As will be described later, the water supply flow channel 420 or the like for the flow of water may be disposed inside the water supply unit 400, and the hose accommodating groove 460 may extend forward while being bent or inflected several times in terms of design considering the water supply flow channel 420 or the like.

The hose accommodating groove 460 may be opened rearward, so that an entirety of the detergent hose 350 may be inserted into the hose accommodating groove 460. The detergent hose 350 may be accommodated in the hose accommodating groove 460, so that the detergent hose 350 may not protrude or partially protrude from the outer surface of the water supply unit 400.

In one embodiment of the present disclosure, in order to suppress the increase in the volume of the detergent feeder 100 and implement an efficient structure, the detergent of the storage unit 200 is directly supplied into the water supply unit 400 through the detergent hose 350, and the water supply unit 400 has the hose accommodating groove 460 that may accommodate the detergent hose 350 therein defined in the outer surface thereof, so that the unnecessary increase in volume may be effectively suppressed by minimizing a level of protrusion of the detergent hose 350 from the water supply unit 400.

In one example, as shown in FIG. 9, the water supply connector 410 connected to the water supply hose 40 may be disposed, and the water supply connector 410 may be disposed at the rear end of the water supply unit 400. The water supply flow channel 420 connected to the water supply connector 410 and through which the water flows may be disposed in the water supply unit 400.

The water supply portion 430 connected to the water supply flow channel 420 may be disposed inside the water supply unit 400. The water supply portion 430 may be disposed to discharge the water received through the water supply flow channel 420 toward the storage unit 200.

Figure 10:
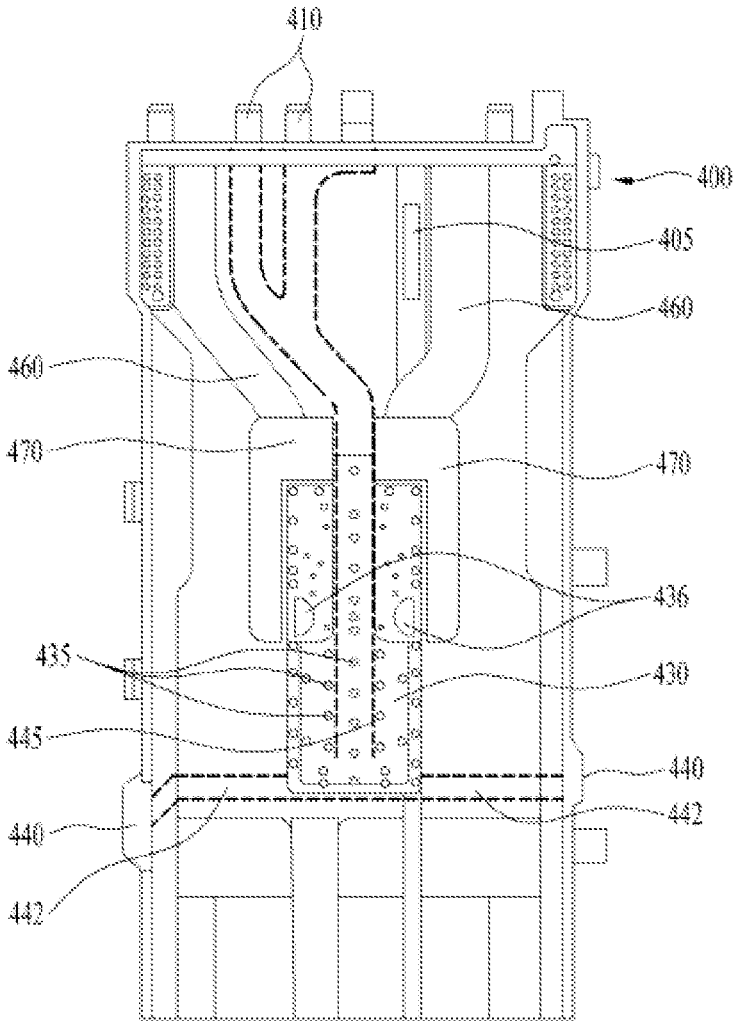
FIG. 10 shows a water supply assembly in a laundry treating apparatus according to an embodiment of the present disclosure viewed from below.

FIG. 10 shows the water supply unit 400 according to an embodiment of the present disclosure viewed from below. FIG. 10 shows one surface of the water supply portion 430 from which the water is discharged from the water supply unit 400 toward the storage unit 200. The water supply portion 430 may have a plurality of water discharge holes 435 defined therein through which the water is discharged, and may have a residence space defined therein in which the water is retained.

In one example, as shown in FIGS. 9 and 10, in one embodiment of the present disclosure, the water supply unit 400 may include the shower flow channel 442 extending from the water supply portion 430 and the shower portion 440 connected to the shower flow channel 442.

The shower flow channel 442 may extend from the water supply portion 430, so that at least a portion of the water supplied to the water supply portion 430 is delivered to the shower flow channel 442 and flows through the shower flow channel 442. In addition, the shower portion 440 may be configured to discharge the water delivered through the shower flow channel 442.

The shower portion 440 may be configured such that the water is supplied to the bottom surface 301 of the supply casing 300 by avoiding the storage unit 200. The shower portion 440 may be disposed at each of both ends of the water supply unit 400 in a lateral direction to avoid the storage unit 200, and the water discharged from the shower portion 440 may fall from the water supply unit 400 and be delivered to the shower water flow groove 305 of the supply casing 300.

The water supplied through the shower portion avoids the storage unit 200 and is supplied to the bottom surface 301 of the supply casing 300, so that the water may be used for cleaning an interior of the supply casing 300.

That is, in one embodiment of the present disclosure, the water supply unit 400 includes the shower portion 440 for supplying the water to an inner surface of the supply casing 300 in addition to the water supply portion 430 for supplying the water to the storage unit 200, so that the interior of the supply casing 300 where the detergent and the water may flow or remain may be washed, which may improve the hygiene.

In addition, the shower portion 440 may be disposed at a front portion of the water supply unit 400. For example, at least a portion of the shower portion 440 may be located forwardly of the water supply portion 430. Accordingly, the water supplied from the shower portion 440 may be utilized for washing a front portion of the supply casing 300. The supply casing 300 may increase a flow region of the water supplied from the shower portion 440 through the shower water flow groove 305, and a guide rib for guiding the flow of water may be disposed on the bottom surface 301 of the supply casing 300, so that the front portion of the supply casing 300 may be washed.

In one embodiment of the present disclosure, because the detergent and the water are discharged out of the storage unit 200, and the storage unit 200 moves along the front and rear direction to be inserted into or extended from the cabinet 10, the detergent or the like may unintentionally leak from the storage unit 200 in the process of movement of the storage unit 200, and the detergent leaking from the storage unit 200 may generally be present forwardly of the detergent discharge portion 220 of the storage unit 200.

Accordingly, in one embodiment of the present disclosure, the shower portion 440 supplies the water to the supply casing 300 while at least a portion thereof is located forwardly of the water supply portion 430, so that the inner surface of the supply casing 300, including the front portion of the supply casing 300 may be washed, which may improve the hygiene.

In one example, in one embodiment of the present disclosure, the storage space 210 of the storage unit 200 may include the first space 212 in which the first detergent is stored and in communication with the detergent hose 350, and the second space 214 in which the second detergent is stored.

The water supply unit 400 may be configured to receive the first detergent through the detergent hose 350 and supply the first detergent to the second space 214, and the storage unit 200 may include the detergent discharge portion 220 from which the detergent of the second space 214 is discharged to the outside.

Referring to FIGS. 7 to 9, the storage unit 200 may include the first space 212 and the second space 214, and the first space 212 and the second space 214 may respectively include a plurality of first spaces and a plurality of second spaces. In one embodiment of the present disclosure, the first space 212 may have a shape extending to a rear end of the storage unit 200.

The first space 212 and the second space 214 may store different detergents. For example, the first detergent may be stored in the first space 212 and the second detergent may be stored in the second space 214. As described above, the first detergent and the second detergent are only distinguished based on the difference in the storage space, and may be detergents of the same nature.

The first space 212 of the storage unit 200 may be connected to the detergent hose 350 through the detergent connecting portion 213, the detergent pump 320, and the like. That is, the first detergent stored in the first space 212 of the storage unit 200 may flow out of the storage unit 200 through the detergent hose 350. The first detergent may be a liquid detergent with fluidity.

The water supply unit 400 may be configured to receive the first detergent through the detergent hose 350, and to supply the first detergent back to the second space 214 of the storage unit 200. The water supply unit 400 may supply the first detergent together with the water to the second space 214 of the storage unit 200 through the water supply portion 430.

In one embodiment of the present disclosure, the second space 214 of the storage unit 200 may have an open top surface, and the water supply portion 430 may be positioned above the second space 214 to drop the water and the first detergent. That is, the water and the detergent discharged from the water supply portion 430 may be supplied to the second space 214 of the storage unit 200.

The storage unit 200 may include the detergent discharge portion 220 in communication with the second space 214, and the water and the detergent present in the second space 214 may be discharged to the outside of the storage unit 200 through the detergent discharge portion 220. The detergent and the water discharged through the detergent discharge portion 220 may flow on the bottom surface 301 of the supply casing 300 and be discharged to the outside of the detergent feeder 100 through the drain portion 310 of the supply casing 300, and may be supplied to the drum 30 or the tub 20.

The process of in which the detergent is delivered from the detergent feeder 100 including the storage unit 200 having the first space 212 connected to the detergent hose 350 and the second space 214 including the detergent discharge portion 220 will be described as follows.

First, the first detergent may be stored in the first space 212 and the second detergent may be stored in the second space 214 of the storage unit 200. The first detergent stored in the first space 212 may be delivered to the water supply unit 400 through the detergent hose 350.

The water supply unit 400 may receive the first detergent through the detergent hose 350 and receive the water through the water supply hose 40. The water supply unit 400 may supply the first detergent and the water together through the water supply portion 430 to the second space 214 of the storage unit 200.

In the second space 214 of the storage unit 200, the first detergent and the water supplied through the water supply portion 430 are present along with the second detergent. The detergent and the water of the second space 214 may be discharged to the outside through the detergent discharge portion 220 and may be ultimately supplied to the tub 20 or the drum 30.

In one embodiment of the present disclosure, the storage unit 200 may include the storage space 210 that is partitioned into a plurality of spaces to store different types of detergent therein, and the detergent discharge portion 220 is disposed in one space, for example, the second space 214, without implementing a detergent discharge structure of each of the plurality of spaces, so that the detergents respectively in the first space 212 and the second space 214 partitioned from each other may be discharged together to the outside of the storage unit 200 through one detergent discharge portion 220, which is advantageous because the plurality of detergents may be usefully used while simplifying the structure.

Figure 11:
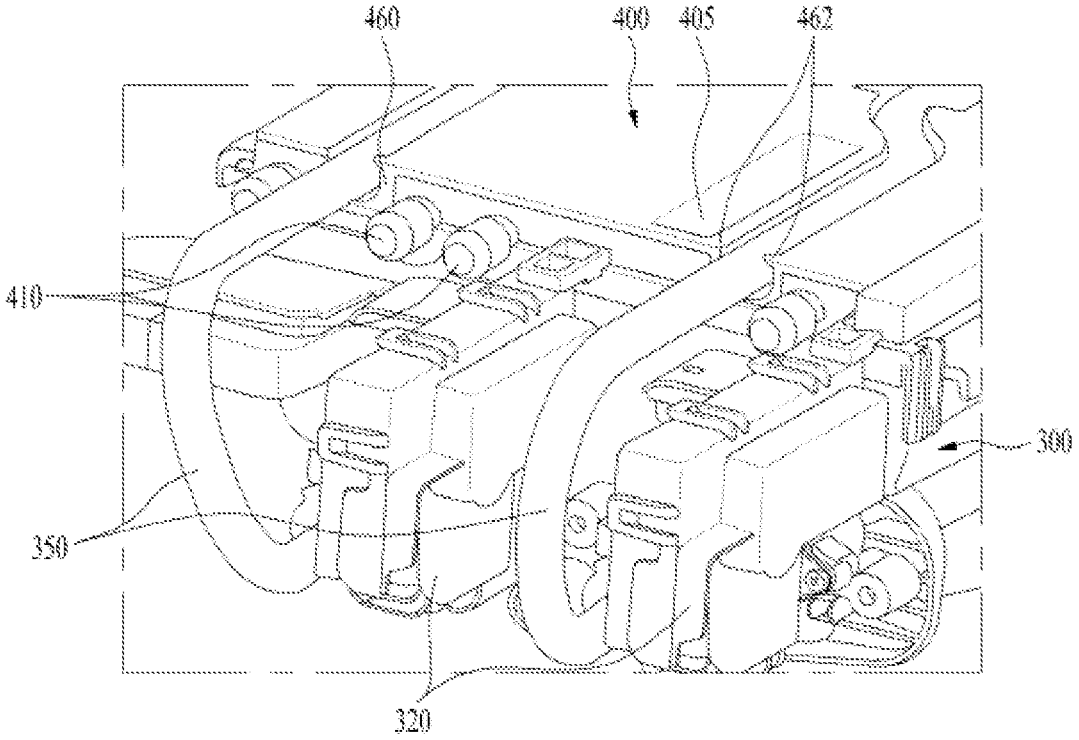
FIG. 11 shows a detergent feeder in a laundry treating apparatus according to an embodiment of the present disclosure viewed from the rear.

In one example, FIG. 11 shows the detergent feeder 100 in the laundry treating apparatus 1 according to an embodiment of the present disclosure viewed from the rear. As described above, in one embodiment of the present disclosure, the detergent feeder 100 may include the supply casing 300, and the supply casing 300 may accommodate the storage unit 200 therein, and include the drain portion 310 for discharging the detergent discharged through the detergent discharge portion 220 toward the tub 20.

In addition, the supply casing 300 may include the detergent pump 320 that is connected to the first space 212 of the storage unit 200 to flow the first detergent, and the detergent hose 350 may be connected to the detergent pump 320 to flow the first detergent.

The storage unit 200 is a component having the space where the detergent is stored defined therein, and moved by the user. Therefore, when the detergent pump 320 is disposed directly on the storage unit 200, it may be disadvantageous to the user to move the storage unit 200 and to secure the storage space 210 of the detergent. Furthermore, it may be disadvantageous for handling of the storage unit 200, such as separation of the storage unit 200 from the cabinet 10.

Therefore, in one embodiment of the present disclosure, the detergent pump 320 is disposed on the supply casing 300 that accommodates therein the storage unit 200 that is inserted into the cabinet 10, and the detergent pump 320 is configured to be in communication with the first space 212 by being connected to the storage unit 200 accommodated in the supply casing 300, so that the detergent may flow effectively from the storage unit 200 that is inserted into the cabinet 10.

In one example, as shown in FIG. 9, in one embodiment of the present disclosure, the water supply unit 400 may include the water supply connector 410, the water supply flow channel 420, the water supply portion 430, and the detergent connector 450.

The water supply hose 40 through which the water flows may be connected to the water supply connector 410, the water supply flow channel 420 may extend from the water supply connector 410 such that the water flows therethrough, the water supply portion 430 may be connected to the water supply flow channel 420 such that water is discharged into the second space 214, and the detergent connector 450 may be in communication with the water supply portion 430.

The detergent hose 350 may extend along the hose accommodating groove 460 and be connected to the detergent connector 450, so that the first detergent may be delivered to the water supply portion 430.

In one embodiment of the present disclosure, the water supply unit 400 may be configured to supply the water to the storage unit 200 through the water supply portion 430, and the water supply portion 430 may be configured to supply the water to the second space 214 of the storage unit 200.

Figure 12:
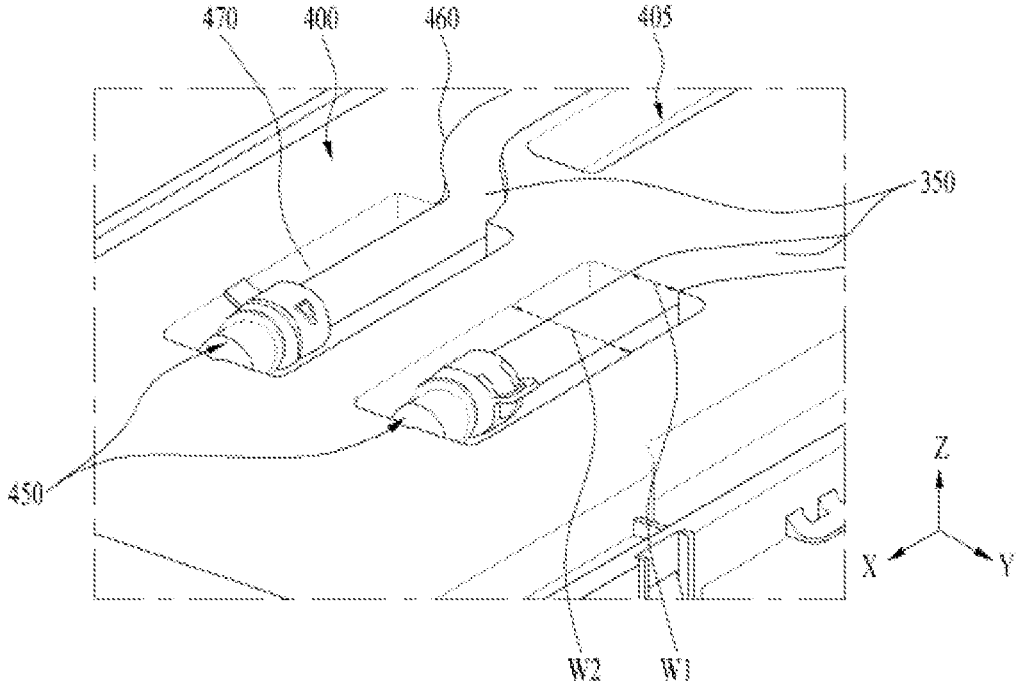
FIG. 12 shows a detergent connector of a water supply assembly in a laundry treating apparatus according to an embodiment of the present disclosure.

In one example, FIG. 12 shows the detergent connector 450 disposed on the outer surface of the water supply unit 400 according to an embodiment of the present disclosure. Referring to FIG. 12, the water supply connector 410 is spaced apart from the water supply portion 430 and connected to the water supply portion 430 through the water supply flow channel 420, so that the water flows inside the water supply unit 400. However, because the detergent connector 450 is located directly on the water supply portion 430, and the detergent introduced through the detergent hose 350 is directly supplied into the water supply portion 430 through the detergent connector 450, a separate detergent flow channel may be omitted.

The water supply unit 400 may discharge the detergent supplied through the detergent hose 350 and the water supplied through the water supply hose 40 to the second space 214 of the storage unit 200 together through the water supply portion 430.

Figure 13:
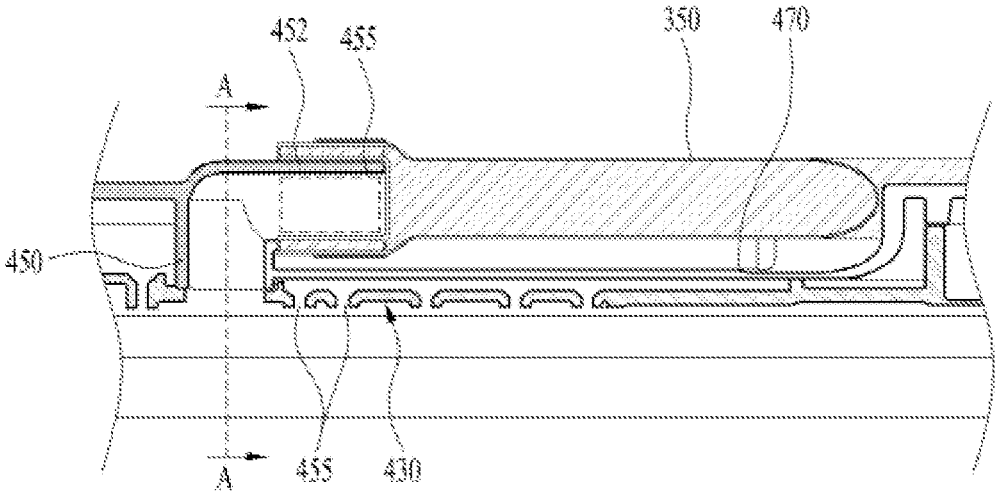
FIG. 13 is a view showing a cross-section of a detergent connector of a water supply assembly in a laundry treating apparatus according to an embodiment of the present disclosure viewed from the side.
Figure 14:
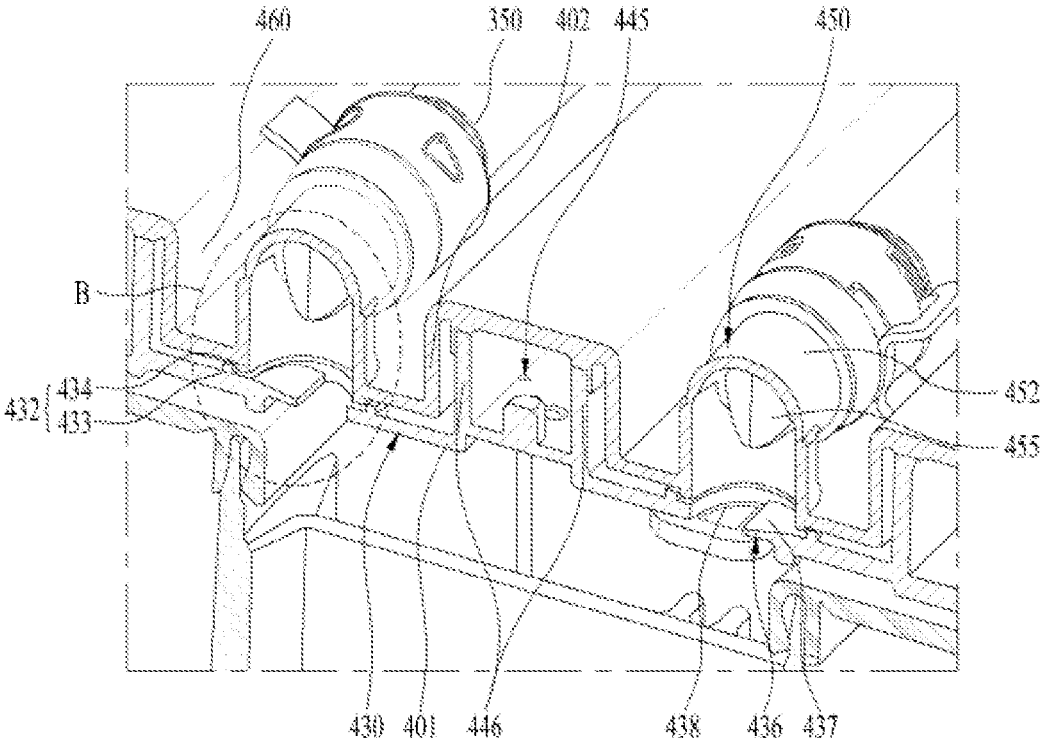
FIG. 14 is a view showing a state in which a detergent connector in FIG. 13 is cut along a line A-A.

In one example, FIG. 13 shows a cross-section of the water supply unit 400 according to an embodiment of the present disclosure viewed from the side, and FIG. 14 shows an interior of the detergent connector 450 cut along a line A-A in FIG. 13.

Referring to FIGS. 13 and 14, in one embodiment of the present disclosure, the water supply portion 430 may be positioned to face the second space 214, and the detergent connector 450 may be positioned on a side opposite to the second space 214.

In one embodiment of the present disclosure, the water supply unit 400 may be located above the storage unit 200, and a portion of a bottom surface of the water supply unit 400 may correspond to a bottom surface of the water supply portion 430. The water supply portion 430 is located above the storage unit 200, so that the water discharged through the bottom surface of the water supply portion 430 may be supplied to the storage unit 200.

The water supply portion 430 may be located above the second space 214 of the storage unit 200 as shown in FIG. 14. Therefore, the water and the detergent discharged through the water supply portion 430 may be supplied to the second space 214 of the storage unit 200.

In one example, the detergent connector 450 may be located on a side opposite to the second space 214 with respect to the water supply portion 430. For example, when the second space 214 is located below the water supply portion 430 as shown in FIG. 14, the detergent connector 450 may be located above the water supply portion 430. That is, the detergent connector 450 may be disposed on a top surface of the water supply portion 430.

The detergent connector 450 may be in communication with an internal space of the water supply portion 430. Accordingly, the detergent hose 350 may be connected to the detergent connector 450 to supply the detergent directly into the water supply portion 430.

In one example, when referring back to FIG. 11, in one embodiment of the present disclosure, the water supply unit 400 may include a hose retainer 462 located on one open surface of the hose accommodating groove 460 and suppressing departure of the detergent hose 350.

The hose accommodating groove 460 may include an inner surface recessed from the outer surface of the water supply unit 400. The detergent hose 350 may be accommodated in the hose accommodating groove 460 and come into contact with the inner surface of the hose accommodating groove 460. The hose accommodating groove 460 may include the hose retainer 462 extending from the outer surface of the water supply unit 400 in a direction transverse to a longitudinal direction of the hose accommodating groove 460 and positioned on said one open surface of the hose accommodating groove 460.

In FIG. 11, according to one embodiment of the present disclosure, the hose accommodating groove 460 may be defined in the top surface of the water supply unit 400, the hose accommodating groove 460 may have a shape recessed downward from the top surface of the water supply unit 400 and may have an open top surface, and the hose retainer 462 may extend from the top surface of the water supply unit 400 and be positioned on the open top surface of the hose retainer 462.

In other words, the hose accommodating groove 460 may include the hose retainer 462 protruding from the inner surface thereof, and a width of the open top surface of the hose accommodating groove 460 may be smaller than a width of the detergent hose 350 by the hose retainer 462.

In other words, the hose retainer 462 may be configured to protrude from the inner surface of the hose accommodating groove 460 or from said one surface of the water supply unit 400, and at least a portion of the hose accommodating groove 460 may have a width smaller than that of the detergent hose 350 by the hose retainer 462.

The hose retainer 462 may be configured to extend from said one surface of the water supply unit 400 toward the hose accommodating groove 460 to cover a portion of said one open surface of the hose accommodating groove 460.

The hose retainer 462 may extend along the longitudinal direction of the detergent hose 350 together with the hose accommodating groove 460. The hose retainer 462 may be formed over an entirety or a portion of a length of the hose accommodating groove 460.

When defining the direction transverse to the longitudinal direction of the detergent hose 350 as a width direction, a width W1 of the hose accommodating groove 460 along the width direction may be equal to or greater than a width of the detergent hose 350, and the departure of the detergent hose 350 inserted into the hose accommodating groove 460 may be suppressed as there is a section in which the width of the hose accommodating groove 460 is reduced by the hose retainer 462.

The hose retainers 462 may be disposed on both sides in the width direction of the hose accommodating groove 460, respectively. In this case, a width between the hose retainers 462 is smaller than the width of the detergent hose 350, so that the departure of the detergent hose 350 may be suppressed.

The hose retainer 462 may be integrally formed with the water supply unit 400 or the hose accommodating groove 460 or manufactured separately from and coupled to the water supply unit 400 or the hose accommodating groove 460.

In one example, in one embodiment of the present disclosure, the detergent connector 450 may include an extending coupling portion 452 in communication with the water supply portion 430 and extending in parallel with the hose accommodating groove 460 to be coupled to the detergent hose 350. FIGS. 12 to 14 show the detergent connector 450 including the extending coupling portion 452 according to an embodiment of the present disclosure.

An end of the detergent hose 350 may be coupled to the extending coupling portion 452. For example, the extending coupling portion 452 may extend parallel to the longitudinal direction of the detergent hose 350 or the longitudinal direction of the hose accommodating groove 460, and the end of the detergent hose 350 may be inserted into the extending coupling portion 452 or coupled with the extending coupling portion 452 to surround the extending coupling portion 452.

The extending coupling portion 452 may be disposed inside the hose accommodating groove 460 or may be positioned to be spaced apart from the hose accommodating groove 460. FIGS. 13 and 14 show a state in which the detergent connector 450 includes a protruding extension that protrudes away from the water supply unit 400, and the extending coupling portion 452 extends from the protruding extension, according to an embodiment of the present disclosure.

The extending coupling portion 452 may be disposed to face an end of the hose accommodating groove 460. That is, the detergent hose 350 may be coupled to the extending coupling portion 452 with the same extending direction along the hose accommodating groove 460.

That is, a direction of coupling between the detergent hose 350 and the extending coupling portion 452 may be the same as the longitudinal direction of the detergent hose 350 or the longitudinal direction of the hose accommodating groove 460. When the longitudinal direction of the detergent hose 350 and the hose accommodating groove 460 changes differently along a length thereof, the extending direction and the coupling direction of the extending coupling portion 452 may be the same as a longitudinal direction of an end of the detergent hose 350 or the hose accommodating groove 460 facing the extending coupling portion 452.

When the extending coupling portion 452 of the detergent connector 450 has a longitudinal direction different from that of the hose accommodating groove 460, for example, when the detergent connector 450 is disposed on the top surface of the water supply unit 400, and the extending coupling portion 452 protrudes upward from the top surface of the water supply unit 400, at least a portion of the detergent hose 350 may be spaced apart from the water supply unit 400 in order to be coupled with the extending coupling portion 452, so that the end of the detergent hose 350 and the end of the extending coupling portion 452 may be disposed such that the longitudinal directions thereof are parallel to each other.

In the above case, for the coupling between the detergent hose 350 and the detergent connector 450, the space used unnecessarily may increase, for example, the detergent hose 350 may be spaced apart from the water supply unit 400, which may be disadvantageous to the space utilization or to secure the storage space 210 of the storage unit 200.

Therefore, in one embodiment of the present disclosure, the detergent hose 350 extends parallel to the outer surface of the water supply unit 400 and is disposed on the outer surface of the water supply unit 400, and at the same time, the coupling portion 452 of the detergent connector 450 also extends parallel to the outer surface of the water supply unit 400, so that it may be possible to effectively suppress the detergent hose 350 that is coupled to the detergent connector 450 from occupying unnecessary space.

In one example, in one embodiment of the present disclosure, a backflow preventing portion 455 that prevents backflow of the detergent may be disposed inside the detergent connector 450 or the detergent hose 350.

Figure 15:
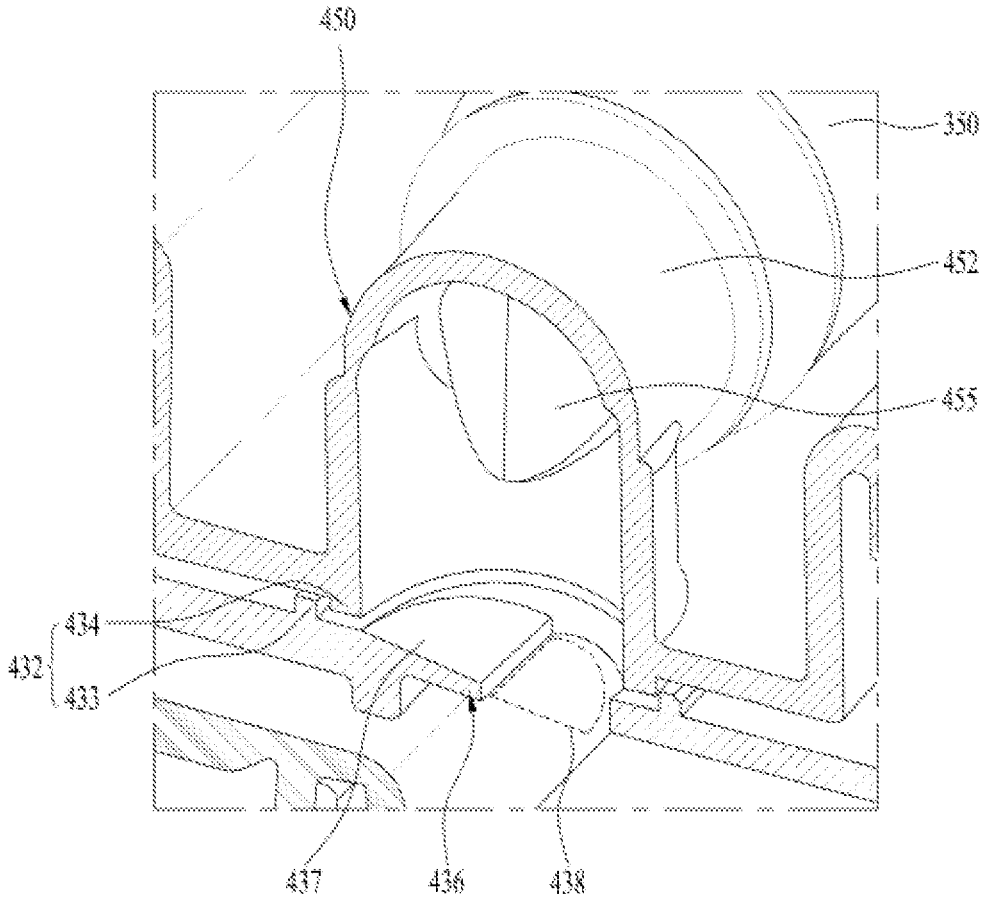
FIG. 15 is an enlarged view of a region B in FIG. 14.

FIG. 14 shows a view in which the backflow preventing portion 455 is disposed inside the detergent connector 450 according to an embodiment of the present disclosure. In addition, FIG. 15 is an enlarged view of a region B in FIG. 14, and shows the backflow preventing portion 455 inside the detergent connector 450.

The backflow preventing portion 455 may be configured to allow flow of detergent only in set one direction, and limit flow in a direction opposite to said one direction. For example, the backflow preventing portion 455 may be of a check valve type that allows only flow of detergent from the storage unit 200 toward the water supply unit 400.

The water supply portion 430 eventually becomes in communication with the water supply hose 40. In one embodiment of the present disclosure, the water supply unit 400 may be located above the storage unit 200, so that, in the detergent hose 350 connected to the water supply portion 430, the water may flow backward from the water supply portion 430 or the detergent may not flow into the water supply portion 430 because of a pressure of the water supply portion 430 or the like.

In order to prevent the above case, the backflow preventing portion 455 may be disposed inside the detergent connector 450 or the detergent hose 350 to allow the detergent flowing toward the water supply portion 430 by the detergent pump 320 or the like to flow into the water supply portion 430 without flowing backward.

In one example, in one embodiment of the present disclosure, a connector accommodating portion 470 that is recessed inwardly of the water supply unit 400 and is connected to the hose accommodating groove 460 may be defined in the outer surface of the water supply unit 400.

In addition, the detergent connector 450 may be disposed in the connector accommodating portion 470, so that the extending coupling portion 452 may be disposed in parallel with the longitudinal direction of the detergent hose 350. FIGS. 12 and 13 show the connector accommodating portion 470 defined in the outer surface of the water supply unit 400 according to an embodiment of the present disclosure.

The connector accommodating portion 470 may be formed in a shape of a groove recessed inwardly of the outer surface of the water supply unit 400. The detergent connector 450 may be disposed inside the connector accommodating portion 470. The connector accommodating portion 470 is connected to the hose accommodating groove 460, so that the end of the detergent hose 350 extending along the hose accommodating groove 460 may be located inside the connector accommodating portion 470.

A depth of the groove shape, that is, a recessed depth in the water supply unit 400 of the connector accommodating portion 470 may be equal to or greater than a depth of the hose accommodating groove 460. Accordingly, the detergent connector 450 disposed in the connector accommodating portion 470 may be positioned such that the extending coupling portion 452 faces the detergent hose 350. For example, a height of the extending coupling portion 452 may be the same as that of the detergent hose 350.

In one embodiment of the present disclosure, the extending coupling portion 452 of the detergent connector 450 may be disposed in parallel with the detergent hose 350 and the hose accommodating groove 460 to suppress the detergent hose 350 coupled to the extending coupling portion 452 from being spaced apart from the water supply unit 400. Furthermore, as the detergent connector 450 is disposed in the connector accommodating portion 470, the extending coupling portion 452 of the detergent connector 450 has the same height as the detergent hose 350 extending along the hose accommodating groove 460, so that it is possible to minimize the protrusion of the detergent hose 350 and the detergent connector 450 from the water supply unit 400.

In one example, a width W2 of the connector accommodating portion 470 may be greater than the width W1 of the hose accommodating groove 460. FIG. 12 shows the connector accommodating portion 470 having the width W2 greater than that of the hose accommodating groove 460 according to an embodiment of the present disclosure.

The widths W1 and W2 may be defined based on the direction transverse to the longitudinal direction of the detergent hose 350 or the hose accommodating groove 460. For example, the widths may be measured based on the width direction of the water supply unit 400.

The end of the detergent hose 350 facing the detergent connector 450 is coupled to the detergent connector 450, and the width of the connector accommodating portion 470 is large in one embodiment of the present disclosure, so that it is possible to secure a working space for the coupling between the detergent hose 350 and the detergent connector 450, and it is possible to secure a free space to match the longitudinal direction of the end of the detergent hose 350 to the longitudinal direction of the extending coupling portion 452.

In one example, in one embodiment of the present disclosure, a mixing inhibiting rib 432 that is configured to surround the detergent space in which the detergent flows in communication with the detergent connector 450 to inhibit mixing of the detergent and the water may be disposed inside the water supply portion 430.

FIGS. 14 and 15 show the mixing inhibiting rib 432 disposed in the internal space of the water supply portion 430 according to an embodiment of the present disclosure.

The internal space of the water supply portion 430 may be a space in which the water supplied through the water supply flow channel 420 stays before being discharged to the outside. The water supply portion 430 may include the plurality of water discharge holes 435 in communication with the internal space on the bottom surface thereof.

The detergent connector 450 is in communication with the water supply portion 430, so that the detergent is supplied to the internal space of the water supply portion 430. The mixing inhibiting rib 432 may become means of separating the detergent space in communication with the detergent connector 450 from the remaining space in the internal space of the water supply portion 430.

The detergent space in the internal space of the water supply portion 430 may be the space in communication with the detergent connector 450 to allow the detergent to flow therein. The detergent space may correspond to a region directly facing the detergent connector 450.

The mixing inhibiting rib 432 may be configured to surround the detergent space. Therefore, the detergent flowing into the water supply portion 430 through the detergent connector 450 may not be able to flow into the remaining space excluding the detergent space in the internal space of the water supply portion 430 by the mixing inhibiting rib 432, and the water supplied to the internal space of the water supply portion 430 may also be inhibited from flowing into the detergent space.

In one embodiment of the present disclosure, the first detergent is directly supplied to the water supply portion 430, so that the first detergent may be delivered to the second space 214 of the storage unit 200 while minimizing a region in contact with the detergent inside the water supply unit 400. Furthermore, the detergent and the water are separated from each other using the mixing inhibiting rib 432 in the internal space of the water supply portion 430, so that the region in contact with the detergent may be minimized even inside the water supply portion 430, which may improve the hygiene based on the detergent.

FIG. 14 shows a state in which a pair of detergent hoses 350 are disposed, a pair of connector accommodating portions 470 are defined, and a delivery flow channel 445 is defined between the pair of connector accommodating portions 470, according to an embodiment of the present disclosure.

The delivery flow channel 445 may be defined inside the water supply portion 430 and may become means for increasing an amount and a pressure of water provided through the water supply flow channel 420 to be delivered to the shower flow channel 442. The delivery flow channel 445 may extend from the water supply flow channel 420 toward the shower flow channel 442, and the water supplied through the water supply flow channel 420 may flow between the pair of flow channel sidewalls 446.

The flow channel sidewalls 446 may be partially opened to communicate the interior and the exterior of the delivery flow channel 445. In this connection, the exterior of the delivery flow channel 445 may correspond to the internal space of the water supply portion 430. Accordingly, the water supplied through the water supply flow channel 420 may flow along the delivery flow channel 445, and flow to the internal space of the water supply portion 430 through a cut-out 447 defined in the flow channel sidewall 446 of the delivery flow channel 445, and the remainder of the water may be delivered to the shower flow channel 442 along the delivery flow channel 445.

In one example, in one embodiment of the present disclosure, the water supply unit 400 may include a water supply base 401 and a water supply cover 402. The water supply base 401 may be formed in a shape in which one surface of each of the water supply portion 430 and the water supply flow channel 420 is opened, and the water supply cover 402 may be configured to be coupled to the water supply base 401 to shield said one open surface of each of the water supply portion 430 and the water supply flow channel 420.

That is, the water supply portion 430, the water supply flow channel 420, and the like may be formed by the water supply base 401 and the water supply cover 402. FIGS. 14 and 15 show a state in which the water supply cover 402 is coupled to a top portion of the water supply base 401 according to an embodiment of the present disclosure.

The water supply base 401 may form a bottom surface of the water supply unit 400, and the water supply cover 402 may form at least a portion of a top surface of the water supply unit 400. The hose accommodating groove 460, the detergent connector 450, and the connector accommodating portion 470 may be defined in and formed on the water supply cover 402.

In one example, the mixing inhibiting rib 432 may include a first inhibiting rib 433 and a second inhibiting rib 434. The first restraining rib 433 may be disposed on the water supply base 401, and the second restraining rib 434 may be disposed on the water supply cover 402.

The first inhibiting rib 433 and the second inhibiting rib 434 may extend to surround the detergent space. That is, the detergent space may be sequestered from the outside by the first inhibiting rib 433 and the second inhibiting rib 434.

The first inhibiting rib 433 may protrude from the water supply base 401 toward the water supply cover 402, and the second inhibiting rib 434 may protrude from the water supply cover 402 toward the water supply base 401. In one embodiment of the present disclosure, as the first inhibiting rib 433 and the second inhibiting rib 434 surrounding the detergent space are disposed, the first inhibiting rib 433 and the second inhibiting rib 434 may overlap each other to partition the detergent space and the remaining space of the water supply portion 430 from each other, thereby effectively inhibit the mixing between the water and the detergent.

In one example, in one embodiment of the present disclosure, the first inhibiting rib 433 and the second inhibiting rib 434 may be disposed such that one surrounds the other. FIGS. 14 and 15 show a state in which the second inhibiting rib 434 surrounds the detergent space, and the first inhibiting rib 433 surrounds the detergent space and the second inhibiting rib 434 together, according to an embodiment of the present disclosure. However, when necessary, the second inhibiting rib 434 may be configured to surround the first inhibiting rib 433.

In one embodiment of the present disclosure, the first inhibiting rib 433 and the second inhibiting rib 434 overlap each other to surround and close the detergent space, so that the effect of inhibiting the mixing between the water and the detergent may be improved.

Figure 16:
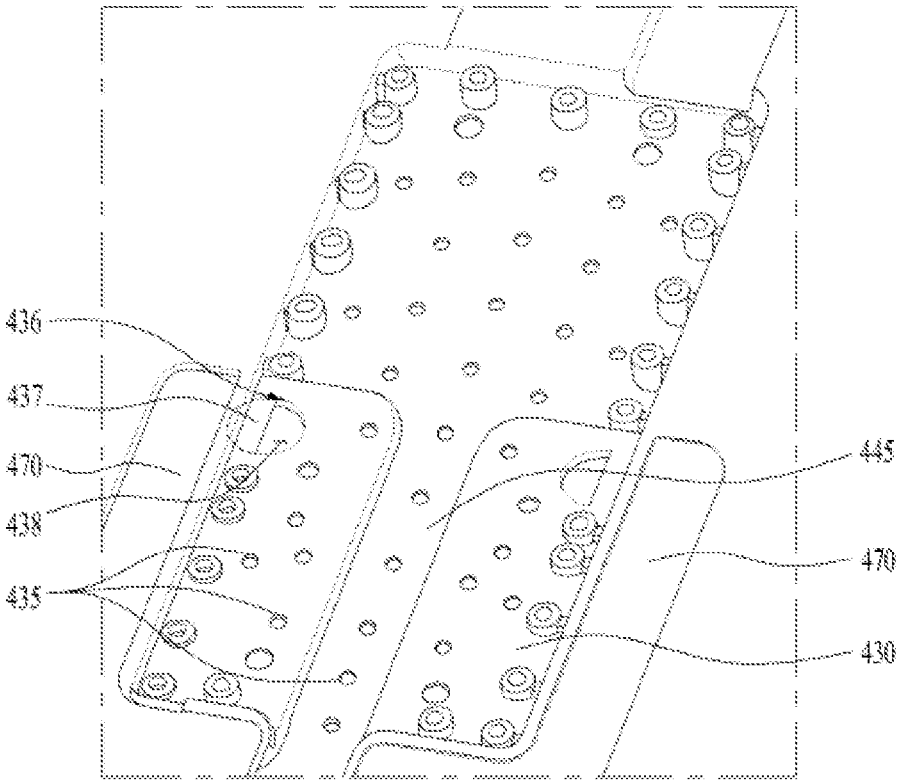
FIG. 16 is a view of a water supply of a water supply assembly in a laundry treating apparatus according to an embodiment of the present disclosure viewed from below.

In one example, FIG. 16 shows the water supply portion 430 according to an embodiment of the present disclosure viewed from below. The bottom surface of the water supply portion 430 may correspond to a portion of the bottom surface of the water supply unit 400.

In one embodiment of the present disclosure, the water supply portion 430 may include the water discharge hole 435 through which the water is discharged, and a detergent discharge hole 436 that is in communication with the detergent space to discharge the detergent, which are defined in one surface of the water supply portion 430 facing the storage unit 200.

The water supply portion 430 may have the water discharge hole 435 and the detergent discharge hole 436 defined in one surface thereof to discharge the water and the detergent. The discharged detergent and water may be supplied to the detergent space in the storage unit 200. In one embodiment of the present disclosure, the water supply unit 400 may be located above the storage unit 200, the water supply portion 430 may be located above the second space 214 of the storage unit 200, and the water supply portion 430 discharges the water and the detergent through the bottom surface thereof, so that the water and the detergent falling from the water supply portion 430 by their own weights may be delivered into the second space 214 through the open top surface of the second space 214.

As described above, the detergent space in which the detergent flows and the remaining space in which the water flows may be separated from each other in the internal space of the water supply portion 430. Accordingly, the detergent discharge hole 436 through which the detergent is discharged and the water discharge hole 435 through which the water is discharged may be separately defined in the water supply portion 430.

Because the detergent discharge hole 436 corresponds to a hole through which the detergent present in the detergent space is discharged, the detergent discharge hole 436 may be defined just below the detergent space, and the water discharge hole 435 may be defined in the bottom surface of the water supply unit 400 corresponding to the internal space of the water supply portion 430. The number of water discharge holes 435 may be various.

In one example, in one embodiment of the present disclosure, the detergent discharge hole 436 has a shielding portion 437 that blocks the flow of the detergent formed in a portion thereof, and the remaining portion of the detergent discharge hole 436 is opened, so that the detergent may flow.

That is, the detergent discharge hole 436 may discharge the detergent through a remaining open region 438 excluding the region shielded by the shielding portion 437.

As described above, the water supply portion 430 may be located above the storage unit 200, the detergent discharged from the detergent discharge hole 436 may be supplied to the second space 214 of the storage unit 200, and the storage unit 200 may be used in a state in which the top surface of the first space 212 is shielded by the detergent cover 230 and the top surface of the second space 214 is opened.

The location of the water supply portion 430 or the location and the size of the detergent discharge hole 436 may be variously determined in terms of design such as the size and the shape of the storage unit 200 and the size and the shape of the water supply unit 400.

However, when considering the above design aspects, there may be a case in which some of the detergent discharge holes 436 deviate from the second space 214 inevitably. In this case, the detergent discharged from the detergent discharge holes 436 may be delivered to regions other than the second space 214, which may cause unnecessary detergent waste, and may deteriorate the cleanliness and the hygiene.

Accordingly, in one embodiment of the present disclosure, the shielding portion 437 that shields the portion of the detergent discharge hole 436 is formed, so that the detergent may be discharged to a desired space by adjusting the open region 438 from which the detergent is discharged in terms of design from the detergent discharge hole 436.

FIG. 15 shows a state in which, as the portion of the detergent discharge hole 436 is located above the detergent cover 230 that is located above the first space 212 out of the second space 214, the shielding portion 437 is formed in a portion of the detergent discharge hole 436 corresponding to a region above the detergent cover 230 to prevent the detergent from falling to the detergent cover 230, according to an embodiment of the present disclosure.

The shielding portion 437 may be formed in a shape inclined toward the open region 438 to prevent some of the detergent from remaining on the shielding portion 437.

FIG. 16 shows the detergent discharge hole 436 including the shielding portion 437 formed therein viewed from below, and the shielding portion 437 is indicated by a dotted lined-region. The shielding portion 437 may have various shapes as needed, such as a partial shape of a circle such as a semicircle, or an arc shape. The open region 438 of the detergent discharge hole 436 may also have various shapes like the shielding portion 437. In addition, as shown in FIG. 16, it may be understood that the detergent discharge hole 436 in which the shielding portion 437 is formed has the partial shape of the circle when viewed from below.

Referring to FIG. 16, in one embodiment of the present disclosure, the detergent space and the detergent discharge hole 436 may be positioned to be partially deviated from the internal space of the water supply portion 430, and the connector accommodating portion 470 may also be positioned such that a portion thereof is deviated from the water supply portion 430 along the width direction of the water supply unit 400.

The delivery flow channel 445 having the pair of flow channel sidewalls 446 may be defined between the connector accommodating portions 470, and the water supply flow channel 420 may be positioned between the pair of detergent hoses 350 and between the pair of hose accommodating grooves 460.

In one example, as described above, one embodiment of the present disclosure may include the cabinet 10, the tub 20, the drum 30, and the detergent feeder 100, the detergent feeder 100 may include the storage unit 200, the detergent hose 350, and the water supply unit 400, at least a portion of the detergent hose 350 may extend along the outer surface of the water supply unit 400, the detergent connector 450 to which the detergent hose 350 is coupled may be disposed on the outer surface of the water supply unit 400, and the detergent connector 450 may include the extending coupling portion 452 that extends along the longitudinal direction of the detergent hose 350 to be coupled to the detergent hose 350 along the longitudinal direction.

Although the present disclosure has been illustrated and described in relation to a specific embodiment, within the limits that do not depart from the technical spirit of the present disclosure provided by the following claims, it will be apparent to those of ordinary skill in the art that the present disclosure may be variously improved and changed.

What is claimed is:

1. A laundry treating apparatus comprising:

a cabinet;

a tub disposed inside the cabinet;

a drum rotatably disposed inside the tub and configured to receive laundry; and a detergent feeder disposed inside the cabinet and configured to supply detergent into the tub, the detergent feeder comprising:

a detergent storage that defines a storage space configured to store the detergent, a detergent hose configured to carry the detergent delivered from the detergent storage, and a water supply connected to the detergent hose and configured to supply the detergent and water to the detergent storage, wherein the water supply includes:

a water supply flow channel that extends inside the water supply and is configured to guide water flow, a hose accommodating groove that extends along a longitudinal direction of the detergent hose, the hose accommodating groove being defined at an outer surface of the water supply and accommodating the detergent hose, a connector accommodating portion that is recessed inward from the outer surface of the water supply and connected to the hose accommodating groove, and a detergent connector is disposed in the connector accommodating portion and connected to the detergent hose, wherein at least a portion of the detergent hose extends along the outer surface of the water supply, and wherein the hose accommodating groove and the water supply flow channel do not overlap with each other along a vertical direction.

2. The laundry treating apparatus of claim 1, wherein the storage space comprises:

a first space configured to store a first detergent and in communication with the detergent hose; and a second space configured to store a second detergent, wherein the water supply is configured to receive the first detergent through the detergent hose and to supply the first detergent to the second space, and wherein the detergent storage comprises a detergent discharge portion configured to discharge at least a portion of the first detergent or the second detergent in the second space to an outside of the detergent storage.

3. The laundry treating apparatus of claim 2, further comprising a water supply hose connected to the water supply and configured to supply the water to the water supply, wherein the water supply further comprises:

a water supply connector connected to the water supply hose and configured to receive the water from the water supply hose, and a water supply portion connected to the water supply flow channel and configured to discharge the water from the water supply flow channel to the second space, wherein the detergent connector is connected to the water supply portion, wherein the water supply flow channel extends from the water supply connector, and wherein the detergent hose extends along the hose accommodating groove and is connected to the detergent connector to thereby deliver the first detergent to the water supply portion through the detergent connector.

4. The laundry treating apparatus of claim 3, wherein the water supply portion faces the second space, and the detergent connector is located at an opposite side of the second space with respect to the water supply portion.

5. The laundry treating apparatus of claim 1, wherein the water supply comprises a hose retainer located at an open surface of the hose accommodating groove and configured to restrict the detergent hose from separating from the hose accommodating groove.

6. The laundry treating apparatus of claim 5, wherein the hose retainer comprises a protrusion that protrudes from an end of the hose accommodating groove and covers at least a portion of the detergent hose.

7. The laundry treating apparatus of claim 1, wherein the detergent connector comprises an extending coupling portion that extends in parallel to the longitudinal direction of the detergent hose and that is coupled to the detergent hose.

8. The laundry treating apparatus of claim 7, wherein the detergent connector or the detergent hose comprises a backflow preventing portion that is disposed inside the detergent connector or the detergent hose and configured to block backflow of the detergent in the detergent hose.

9. The laundry treating apparatus of claim 8, wherein the backflow preventing portion comprises a check valve configured to allow the detergent to flow in one direction along the detergent hose and to block the backflow in another direction along the detergent hose.

10. The laundry treating apparatus of claim 7, wherein the extending coupling portion is disposed parallel to the connector accommodating portion and faces the detergent hose.

11. The laundry treating apparatus of claim 10, wherein a width of the connector accommodating portion is greater than a width of the hose accommodating groove.

12. The laundry treating apparatus of claim 7, wherein the water supply further comprises:

a water supply portion configured to discharge the water to the storage space; and a mixing inhibiting rib that is disposed inside the water supply portion, that defines a detergent space in communication with the detergent connector, and that surrounds the detergent space to thereby block the detergent in the detergent space from mixing with the water in the water supply portion.

13. The laundry treating apparatus of claim 12, wherein the water supply flow channel is connected to the water supply portion and configured to supply the water to the water supply portion, wherein the water supply further comprises:

a water supply base that defines the water supply portion and the water supply flow channel, each of the water supply portion and the water supply flow channel having an open surface; and a water supply cover that is coupled to the water supply base and closes the open surface of each of the water supply portion and the water supply flow channel, and wherein the mixing inhibiting rib comprises a first inhibiting rib that protrudes from the water supply base and a second inhibiting rib that protrudes from the water supply cover.

14. The laundry treating apparatus of claim 13, wherein one of the first inhibiting rib and the second inhibiting rib surrounds the other of the first inhibiting rib and the second inhibiting rib.

15. The laundry treating apparatus of claim 12, wherein the water supply portion defines:

a water discharge hole that faces the detergent storage and is configured to discharge the water therethrough; and a detergent discharge hole that faces the detergent storage and is in communication with the detergent space, the detergent discharge hole being configured to discharge the detergent therethrough.

16. The laundry treating apparatus of claim 15, wherein the water supply portion further comprises a shielding portion that is disposed in the detergent discharge hole and blocks a portion of the detergent discharge hole to thereby block flow of a portion of the detergent through the detergent discharge hole.

17. The laundry treating apparatus of claim 2, wherein the detergent feeder further comprises a supply casing that accommodates the detergent storage therein, the supply casing comprising a drain portion configured to discharge the detergent toward the tub through the detergent discharge portion.

18. The laundry treating apparatus of claim 17, wherein the supply casing further comprises a detergent pump connected to the first space of the detergent storage and configured to cause flow of the first detergent from the detergent storage toward the first space, and wherein the detergent hose is connected to the detergent pump and configured to supply the first detergent to the first space.

19. The laundry treating apparatus of claim 1, wherein the water supply is disposed above the detergent storage, and wherein the connector accommodating portion is recessed downward from the outer surface of the water supply toward the detergent storage.

20. The laundry treating apparatus of claim 1, wherein the connector accommodating portion is recessed downward from the outer surface of the water supply and accommodates portions of the detergent connector and the detergent hose.

* * * * *